US006937919B1

(12) United States Patent
Muto et al.

(10) Patent No.: US 6,937,919 B1
(45) Date of Patent: Aug. 30, 2005

(54) EMBROIDERY DATA PROCESSING APPARATUS

(75) Inventors: Yukiyoshi Muto, Nagoya (JP); Masahiro Mizuno, Nagoya (JP); Mikitoshi Suzuki, Nagoya (JP); Shoichi Taguchi, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/046,762

(22) Filed: Feb. 1, 2005

(30) Foreign Application Priority Data

Mar. 31, 2004 (JP) ..... 2004-107034

(51) Int. Cl.[7] ..... D05C 5/02; G06F 19/00
(52) U.S. Cl. ..... 700/138; 112/475.19
(58) Field of Search ..... 700/138, 136, 700/137; 112/102.5, 475.19, 470.06

(56) References Cited

U.S. PATENT DOCUMENTS 5,775,240 A * 7/1998 Hara et al. ..... 112/102.5
6,587,745 B1 * 7/2003 Polden et al. ..... 700/138
6,629,015 B2 * 9/2003 Yamada ..... 700/138

FOREIGN PATENT DOCUMENTS

JP A 2-133647 5/1990

* cited by examiner

*Primary Examiner*—Peter Nerbun
(74) *Attorney, Agent, or Firm*—Oliff & Berridge, PLC

(57) ABSTRACT

An embroidery data processing apparatus is constructed to execute calculation for forming a plurality of circles with different radii concentrically around a central point, extract circles and arcs that fall within the embroidery region from the thus formed circles, and determine stitch points on the circles and arcs that fall within the embroidery region. The thus created stitching data features thread flows along the arcs and concentric stitches with a new texture, not existing before, can be created.

32 Claims, 34 Drawing Sheets

$f^1$

SHIFT LINES OF CIRCLES FOR 2nd COLOR NOT TO OVERLAP WITH LINES OF CIRCLES FOR 1st COLOR.

f $f^1$

FIG. 35

TRANSFORMATION f:

$\theta$ = ANGLE FORMED BETWEEN x AXIS AND LINE CONNECTING POINT (x, y) AND CENTRAL POINT C (cx, cy)

$$R = \sqrt{(x - cx)^2 + (y - cy)^2} \quad \cdots \text{EQUATION (1)}$$

INVERSE TRANSFORMATION $f^{-1}$:

$$x = R \times \cos\theta + cx$$

$$y = R \times \sin\theta + cy$$

EMBROIDERY DATA PROCESSING APPARATUS

This application claims priority from JP 2004-107034, filed Mar. 31, 2004, the entire disclosure of which is incorporated herein by reference thereto.

BACKGROUND

1. Field

The disclosure relates to an embroidery data processing apparatus and, in particular, to an embroidery data processing apparatus that can represent a variety of rich gradation by making effective use of concentric stitching data and radial stitching data.

2. Description of Related Art

Various kinds of embroidery data processing apparatus of prior art have been proposed heretofore. An embroidery data processing apparatus capable of creating embroidery data so that gradations can be represented by stitches has been proposed as well.

For example, Japanese patent application laid-open No. H02-133647 (1990-133647) discloses an embroidery data processing apparatus configured such that information for variation in thread density per stitching block is recorded and gradation in each stitching block is represented.

The embroidery data processing apparatus described in the above Japanese patent application '647 can form stitches that enable gradation representation to some extent. However, the gradation that can be produced by it is still limited and this apparatus is considered insufficient to represent richer gradation.

SUMMARY

The object of the disclosure which has been made to resolve problems with the prior art apparatus for processing embroidery data is to provide an embroidery data processing apparatus that can represent a variety of rich gradation by making effective use of stitching data of concentric and radial patterns of simple formation.

To achieve the above object, there is provided an embroidery data processing apparatus comprising a processor conducting: a process of setting an embroidery region where embroidering stitches should be formed; a process of setting a central point serving as a reference for forming the embroidering stitches within the embroidery region; a stitching data creation process comprising the steps of: executing calculation for creating a plurality of circles with different radii concentrically around the central point; extracting circles and arcs that fall within the embroidery region from the circles; and determining stitch points on the circles and arcs, thus creating concentric stitching data.

On the embroidery data processing apparatus configured as above, through the stitching data creation process, calculation is executed for forming a plurality of circles with different radii concentrically around the central point, circles and arcs that fall within the embroidery region are extracted from the thus formed circles, and stitch points are determined on the circles and arcs that fall within the embroidery region. The thus created stitching data features thread flows along the arcs and concentric stitches with a new texture, not existing before, can be created.

According to another aspect, there is provided an embroidery data processing apparatus comprising a processor conducting: a process of setting an embroidery region where embroidering stitches should be formed; a process of setting a central point serving as a reference for forming the embroidering stitches within the embroidery region; a stitching data creation process comprising the steps of: changing angular spacing between adjacent half lines of a plurality of half lines radiating from the central point at different angles relative to a predetermined reference direction in a rotation around the central point; and forming stitch points on the plurality of half lines that fall within the embroidery region, thus creating radial stitching data.

On the above embroidery data processing apparatus, through the stitching data creation process, radial stitching data is created in such a manner that angular spacing between adjacent half lines of a plurality of half lines radiating from the central point at different angles relative to a predetermined reference direction is changed in a rotation around the central point and stitch points are formed on the plurality of half lines that fall within the embroidery region. In consequence, by changing angular spacing of radial stitches from the central point, variation in conical (radial) gradation can be obtained.

Further, according to another aspect, there is provided an embroidery data processing apparatus comprising a processor conducting: a process of setting an embroidery region where embroidering stitches should be formed; a process of setting a central point serving as a reference for forming the embroidering stitches within the embroidery region; a stitching data creation process comprising the steps of: executing calculation for creating ellipses deformed from a plurality of circles with different radii concentrically around the central point; extracting curves that fall within the embroidery region from the ellipses; and forming stitch points on the curves, thus creating stitching data.

On the above embroidery data processing apparatus, through the stitching data creation process, stitching data is created in such a manner that calculation is executed for creating ellipses deformed from a plurality of circles with different radii concentrically around the central point, curves that fall within the embroidery region are extracted from the ellipses, and stitch points are formed on the curves. The thus created stitching data features thread flows along elliptical curves and elliptical stitches with a new texture, not existing before, can be created.

Further, according to another aspect, there is provided a computer-readable recording medium storing an embroidery data processing program, comprising: a program for setting an embroidery region where embroidering stitches should be formed; a program for setting a central point serving as a reference for forming the embroidering stitches within the embroidery region; and a stitching data creation program comprising the steps of: executing calculation for creating a plurality of circles with different radii concentrically around the central point; extracting circles and arcs that fall within the embroidery region from the circles; and determining stitch points on the circles and arcs, thus creating concentric stitching data.

By running the embroidery data processing program stored on the above recording medium on the embroidery data processing apparatus, through the stitching data creation program, calculation is executed for forming a plurality of circles with different radii concentrically around the central point, circles and arcs that fall within the embroidery region are extracted from the thus formed circles, and stitch points are determined on the circles and arcs that fall within the embroidery region. The thus created stitching data features thread flows along the arcs and concentric stitches with a new texture, not existing before, can be created.

Further, according to another aspect, there is provided a computer-readable recording medium storing an embroidery data processing program comprising: a program for setting an embroidery region where embroidering stitches should be formed; a program for setting a central point serving as a reference for forming the embroidering stitches within the embroidery region; and a stitching data creation program comprising the steps of: changing angular spacing between adjacent half lines of a plurality of half lines radiating from the central point at different angles relative to a predetermined reference direction in a rotation around the central point; and forming stitch points on the plurality of half lines that fall within the embroidery region, thus creating radial stitching data.

By running the embroidery data processing program stored on the above recording medium on the embroidery data processing apparatus, through the stitching data creation program, radial stitching data is created in such a manner that angular spacing between adjacent half lines of a plurality of half lines radiating from the central point at different angles relative to a predetermined reference direction is changed in a rotation around the central point and stitch points are formed on the plurality of half lines that fall within the embroidery region. In consequence, by changing angular spacing of radial stitches from the central point, variation in conical (radial) gradation can be obtained.

Further, according to another aspect, there is provided a computer-readable recording medium storing an embroidery data processing program comprising: a program for setting an embroidery region where embroidering stitches should be formed; a program for setting a central point serving as a reference for forming the embroidering stitches within the embroidery region; and a stitching data creation program comprising the steps of: executing calculation for creating ellipses deformed from a plurality of circles with different radii concentrically around the central point; extracting curves that fall within the embroidery region from the ellipses; and forming stitch points on the curves, thus creating stitching data.

By running the embroidery data processing program stored on the above recording medium on the embroidery data processing apparatus, through the stitching data creation program, stitching data is created in such a manner that calculation is executed for creating ellipses deformed from a plurality of circles with different radii concentrically around the central point, curves that fall within the embroidery region are extracted from the ellipses, and stitch points are formed on the curves. The thus created stitching data features thread flows along elliptical curves and elliptical stitches with a new texture, not existing before, can be created.

BRIEF DESCRIPTION OF THE DRAWINGS

The accompanying drawings, which are incorporated in and constitute a part of this specification illustrate an embodiment and, together with the description, serve to explain the objects, advantages and principles.

FIG. 35 shows an equation for polar coordinates transformation.

DETAILED DESCRIPTION OF THE PREFERRED EMBODIMENTS

Figure 1:
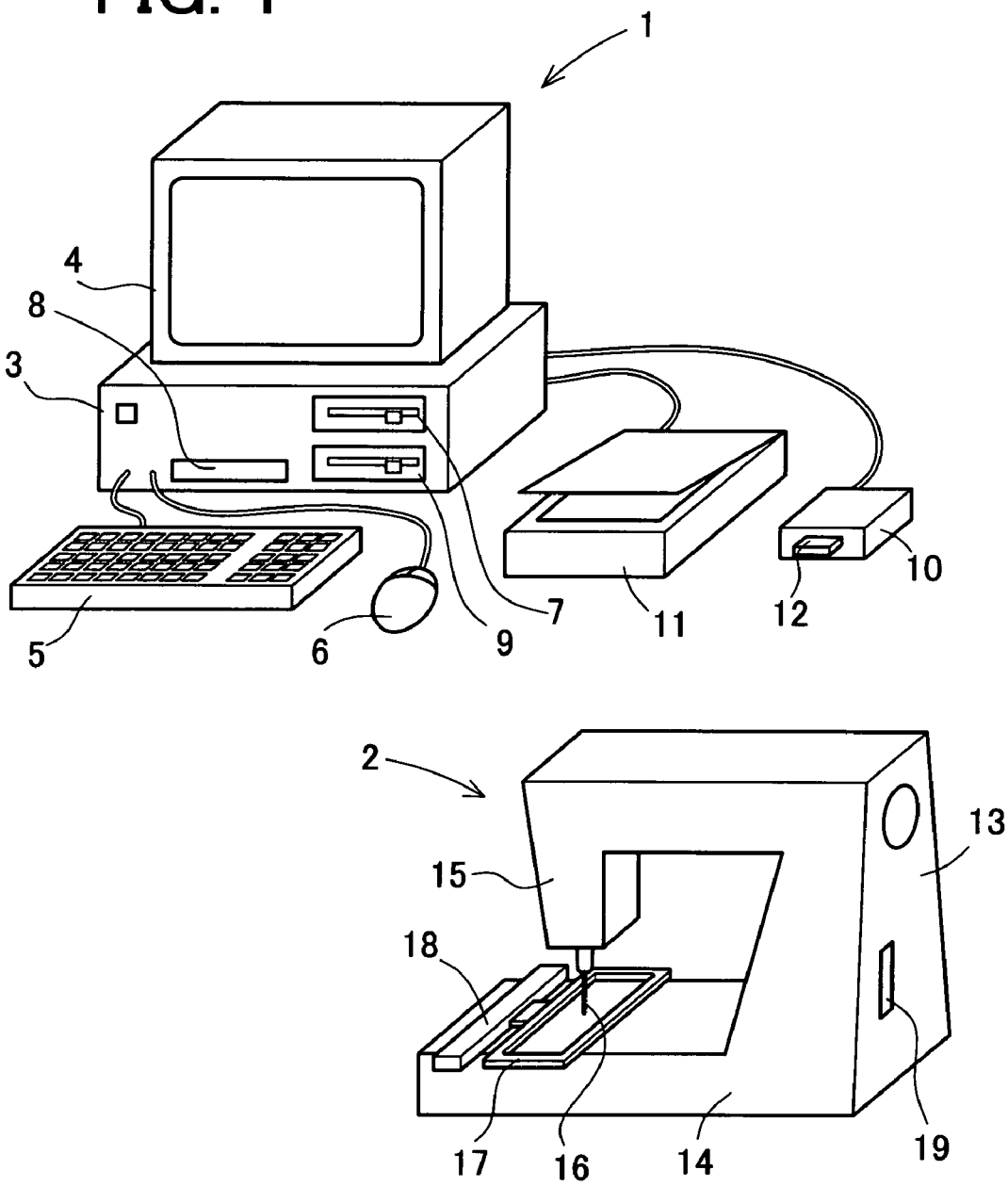
FIG. 1 is a perspective view showing a schematic structure of an embroidery data processing apparatus according to a preferred embodiment.

An embroidery data processing apparatus according to the disclosure will be discussed fully hereinafter, based on its illustrative embodiment and referring to the accompanying drawings. First, a schematic structure of the embroidery data processing apparatus according to the present embodiment is described, referring to FIG. 1. FIG. 1 is the perspective view showing the schematic structure of the embroidery data processing apparatus in the present embodiment.

In FIG. 1, the embroidery data processing apparatus 1 is primarily constructed of a control unit 3. This control unit 3 is equipped with a CRT display 4 which displays images, graphics, characters, etc. Besides, the following are connected to the control unit 3: a keyboard 5, a mouse 6, a flexible disk (FD) drive 7, a hard disk drive 8, a CD-ROM drive 9, a flash memory device 10, and an image scanner 11.

The flexible disk drive 7 is configured such that a flexible disk 7A (see FIG. 2) will be set in it removably. The flexible disk 7A is a recording medium on which an embroidery data processing program which will be described later and other diverse programs are stored. The hard disk drive 8 stores image data, outline data, embroidery data onto a hard disk and reads such data from the hard disk. The CD-ROM drive 9 reads image data, outline data, and embroidery data stored on a CD-ROM. The flash memory device 10 has a slot into which a removable memory card 12 which consists of a nonvolatile flash memory is inserted and writes embroidery data into the memory card 12. The image scanner 11 is used for scanning an embroidery pattern original.

A main body 13 of an embroidering machine 2 is constructed of a bed portion 14 and an upper arm portion 15 integrally provided with the bed portion 14. On the end of the arm portion 15, a needle bar (not shown) with a sewing needle 16 is installed. On the bed portion 14, an embroidery frame 17 which fastens a work cloth to be embroidered (not shown) is placed. The embroidery frame 17 is arranged to be moved to an arbitrary position, based on an X-Y coordinate system intrinsic to the apparatus, by an embroidery frame movement mechanism 18. The embroidering machine 2 embroiders a predetermined pattern on the work cloth set in the embroidery frame 17 by driving the needle bar and a shuttle mechanism (not shown), while the embroidery frame movement mechanism 18 moves the work cloth smoothly.

On the right side of the machine's main body 13, a card insertion slot 19 into which the memory card 12 will be inserted is provided.

The above embroidery frame movement mechanism 18, the needle bar, and other elements are configured to be controlled by a controller (not shown) comprised of a microcomputer and other components. The controller is configured to be externally supplied with embroidery data via the memory card 12. Thus, the controller enables automatic execution of embroidering, according to embroidery data that specifies the distances of movement of the work cloth to be embroidered (stitch positions) in X and Y directions per stitch.

Figure 2:
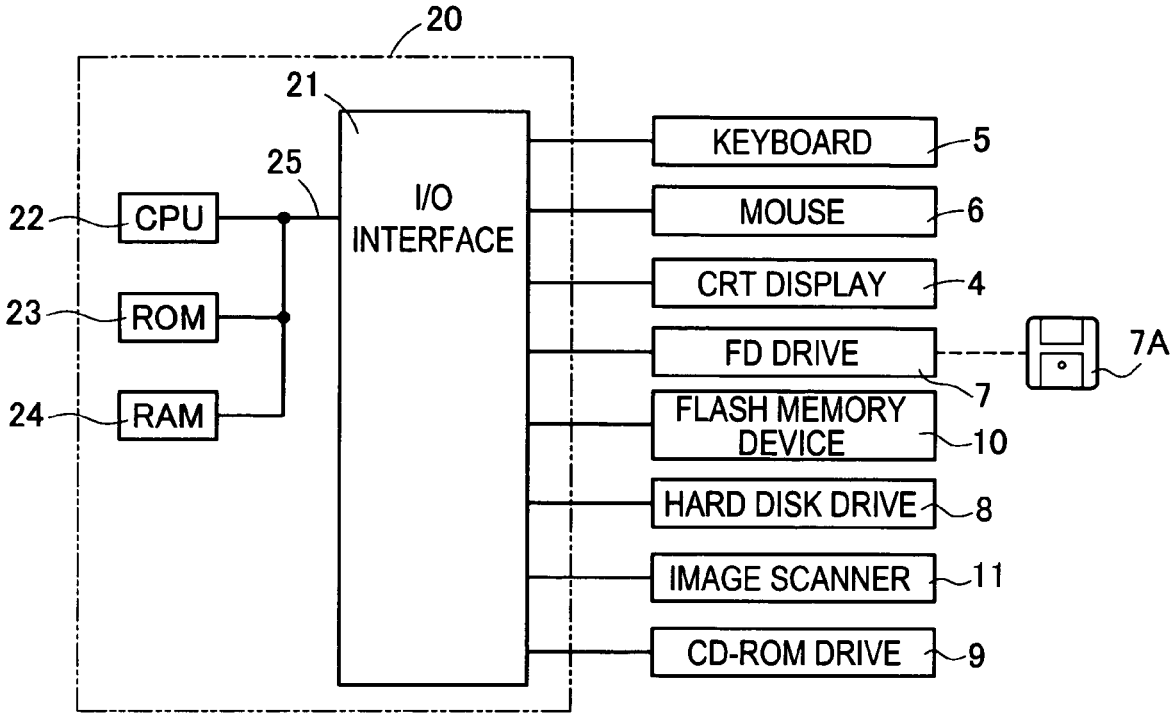
FIG. 2 is a block diagram showing a control system of the embroidery data processing apparatus.

Then, an electrical arrangement of the embroidery data processing apparatus is described, based on FIG. 2. FIG. 2 is a block diagram showing the control system of the embroidery data processing apparatus.

In FIG. 2, a control device 20 (i.e., a processor) built in the control unit 3 is comprised of, e.g., a microcomputer and other circuits and configured such that an I/O interface 21, CPU 22, ROM 23, and RAM 24 are interconnected via a bus line 25.

To the I/O interface 21, the following are connected: the CRT display 4, keyboard 5, mouse 6, flexible disk drive 7, flash memory device 10, hard disk drive 8, image scanner 11, and CD-ROM drive 9.

In the above arrangement, the control device 20 is configured to read the embroidery data processing program stored on the flexible disk 7A via the flexible disk drive 7 and execute an embroidery data creation process, according to this program which has read.

In the ROM 23, control programs required to operate the embroidery data processing apparatus 1 and other diverse kinds of programs or the like required for embroidery data processing are stored. The RAM 24 includes an outline data memory area for storing outline data corresponding to a pattern original of embroidery that is stored through the image scanner 11, an embroidery data memory area for storing embroidery data created from the outline data, and other data memory areas for diverse data required for creating the embroidery data.

Figure 3:
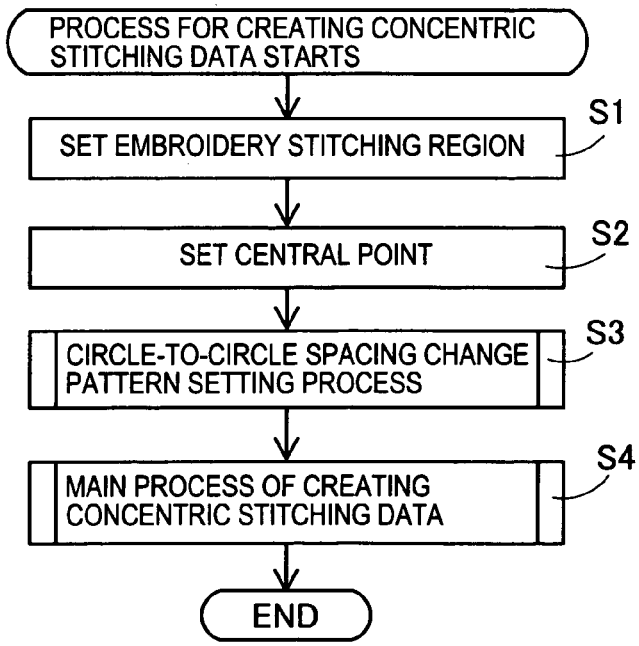
FIG. 3 is a flowchart of a program for a process for creating concentric stitching data.

The processes for creating diverse types of stitching data on the embroidery data processing apparatus 1 configured as above are now described. First, a process for creating concentric stitching data is described with reference to FIG. 3 and other figures. FIG. 3 is a flowchart of a program for the process for creating concentric stitching data.

Figure 15:
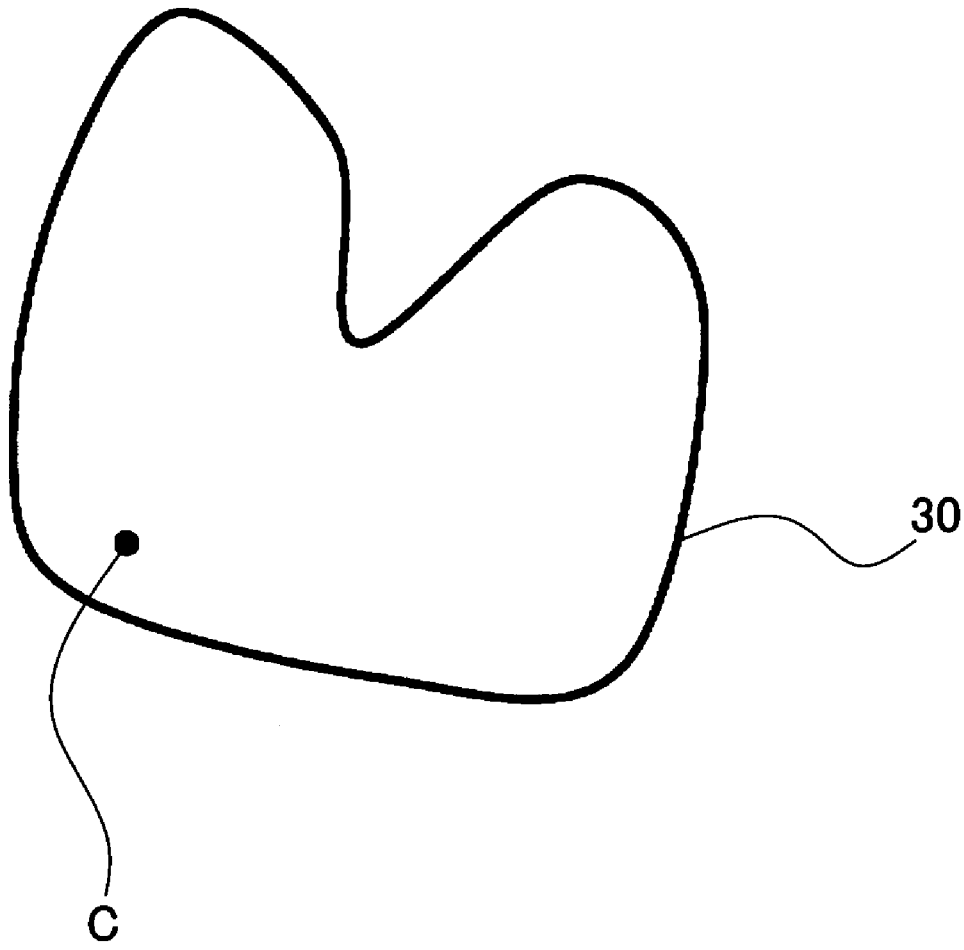
FIG. 15 is an explanatory view which typically illustrates an embroidery region and a central point.

Referring to FIG. 3, in step (hereinafter, referred to as "S") 1, first, an embroidery region 30 where embroidering stitches should be formed is set (see FIG. 15). In the following S2, a central point C serving as the reference for forming embroidering stitches within the embroidery region 30 is set (see FIG. 15).

In S3, as will be detailed below, a process of setting a circle-to-circle spacing change pattern (which will be described later) is performed to regularly change spacing between two adjacent circles of a plurality of concentric circles formed, as the distance from the central point C increases up to the outermost circle. Furthermore, in S4, a process of creating concentric stitching data (which will be described later) is performed.

Figure 4:
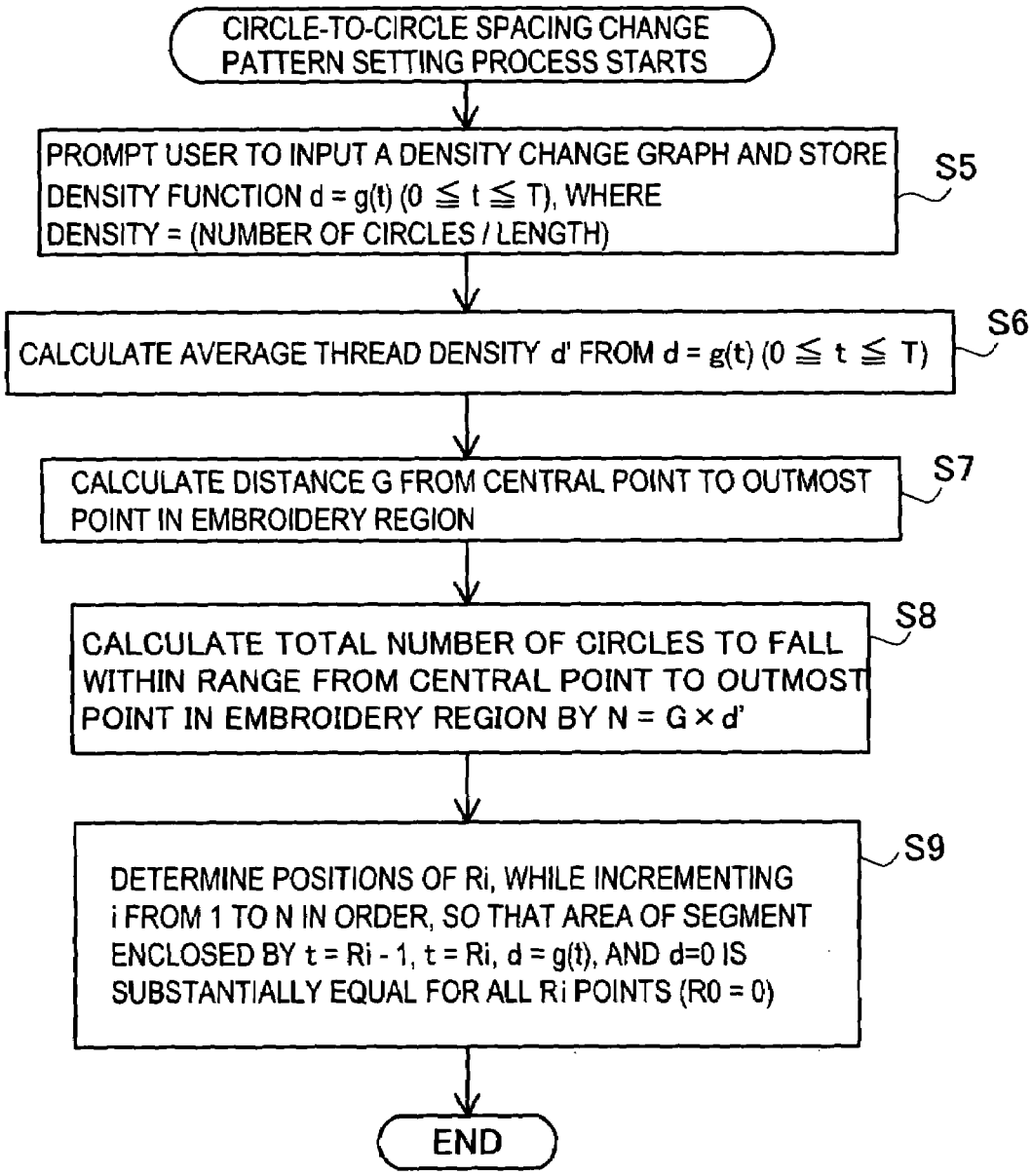
FIG. 4 is a flowchart of a program for a circle-to-circle spacing change pattern setting process.

Then, the circle-to-circle spacing change pattern setting process which is performed in the above S3 is described, referring to FIG. 4. FIG. 4 is a flowchart of a program for the circle-to-circle spacing change pattern setting process. Referring to FIG. 4, in S5, the process prompts a user to input a density change graph by means of the keyboard 5 and stores a density function $d=g(t)$ (where $0 \leqq t \leqq T$) obtained from the user-specified density change graph into the RAM 24. Here, the density is defined as $$\text{Density}=(\text{Number of circles}/\text{Length}).$$

Next, in S6, the process calculates an average thread density d' from the density function $d=g(t)$ (where $0 \leqq t \leqq T$) and, in S7, calculates a distance G from the central point C to the outmost point in the embroidery region 30. In S8, the process calculates the total number of circles N falling within the range from the central point C to the outmost point in the embroidery region 30 by $N=G \times d'$.

Figure 16:
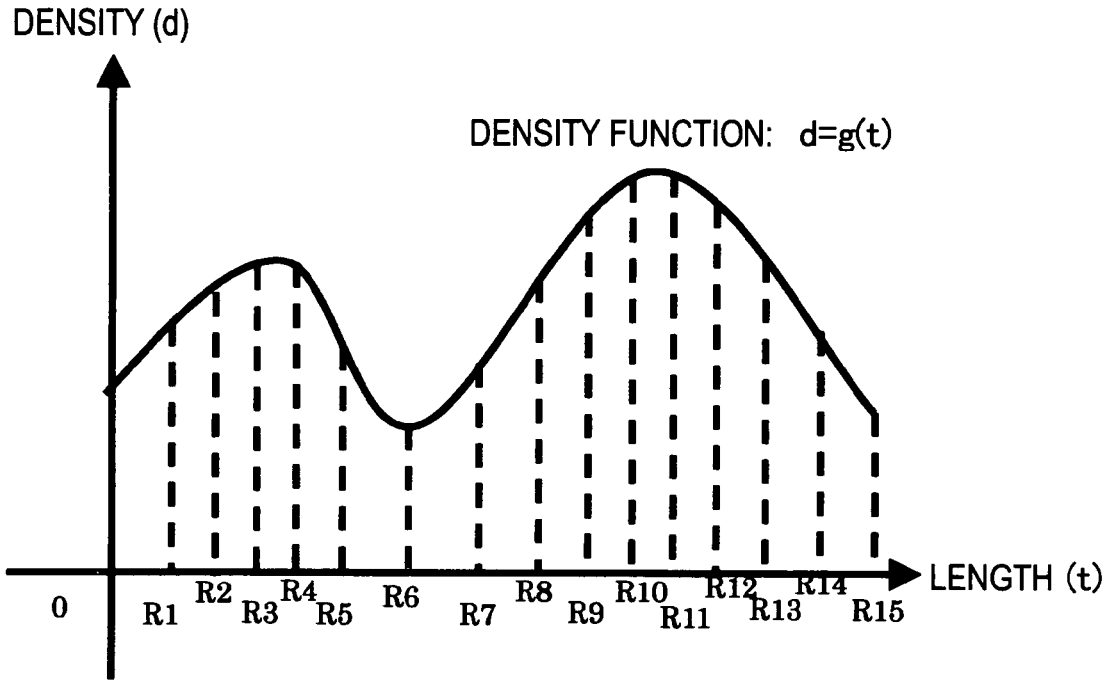
FIG. 16 is a graph representing a circle-to-circle spacing change pattern.

In S9, the process determines positions of Ri, while incrementing i from 1 to N in order, so that the area of a segment enclosed by $t=Ri-1$, $t=Ri$, $d=g(t)$, and $d=0$ is substantially equal for all Ri points, where $R0=0$. Thereby, a circle-to-circle spacing change pattern is set, as shown in FIG. 16. A desired circle-to-circle spacing change pattern can be set optionally by the user; e.g., the user can set a monotonic increase or decrease in circle-to-circle spacing of a plurality of concentric circles formed, as the distance from the central point C increases up to the outermost circle. Here, FIG. 16 is a graph representing a circle-to-circle spacing change pattern with density (d) on the ordinate and length (t) on the abscissa.

Figure 5:
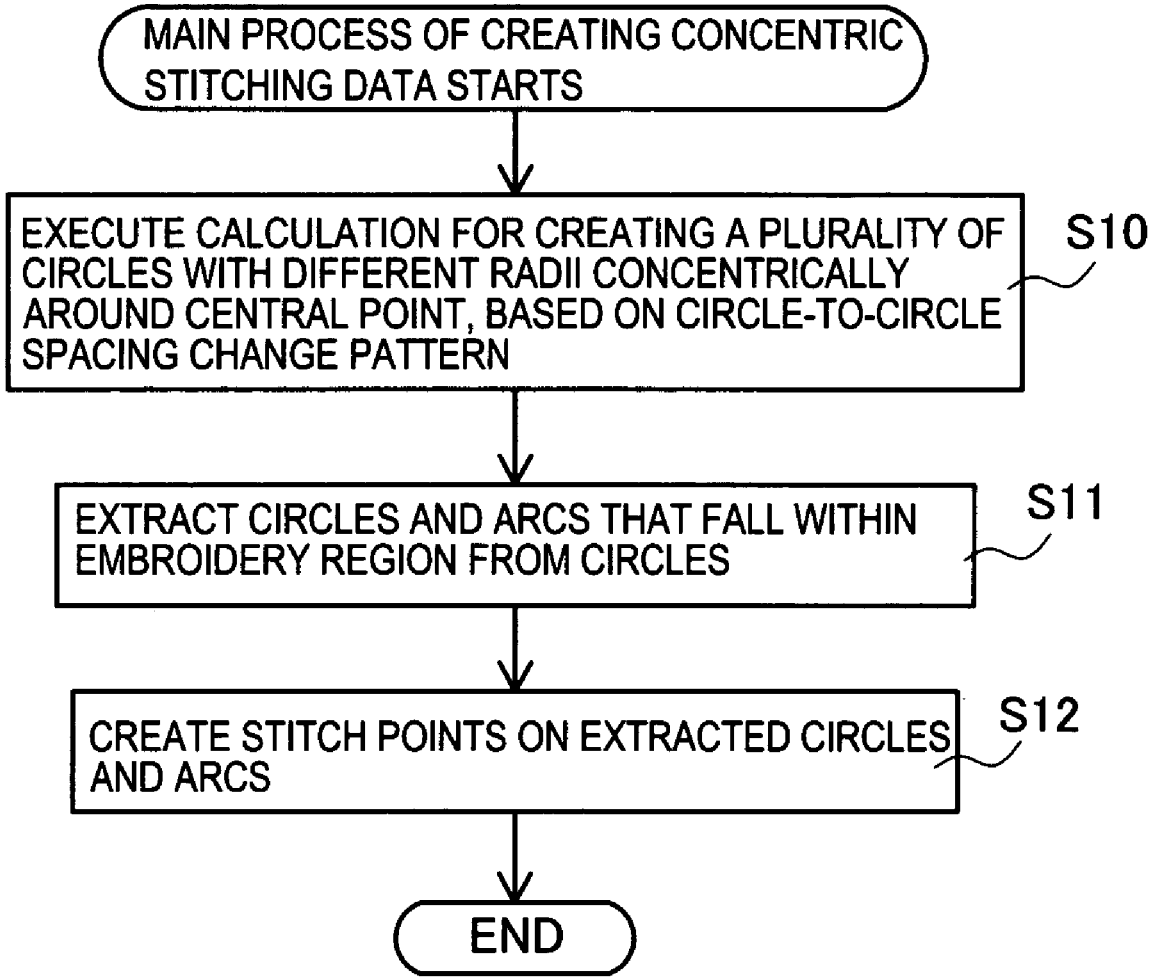
FIG. 5 is a flowchart of a program for a process of creating concentric stitching data according to a first processing method.
Figure 17:
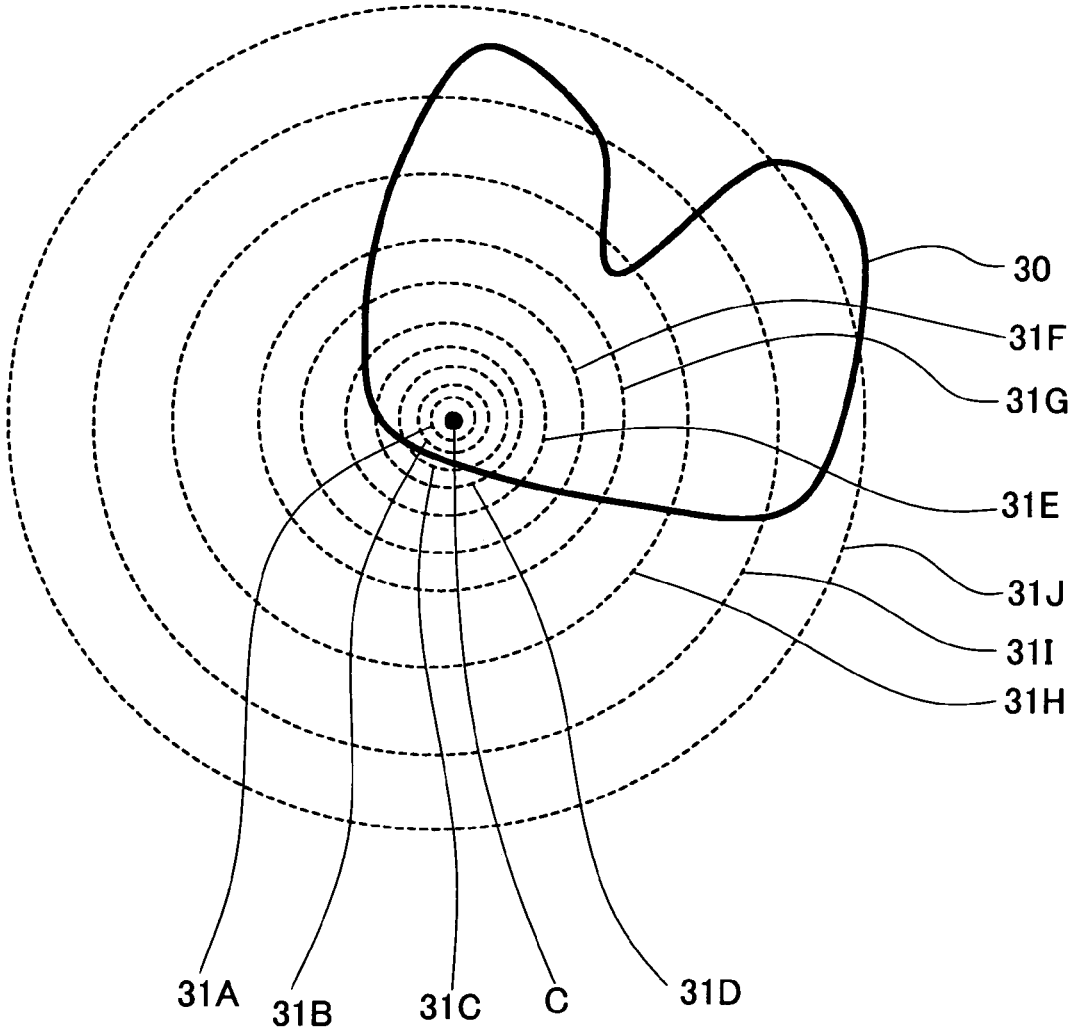
FIG. 17 is an explanatory view which typically illustrates a plurality of circles and arcs created by calculation in the process of creating concentric stitching data according to the first processing method.
Figure 18:
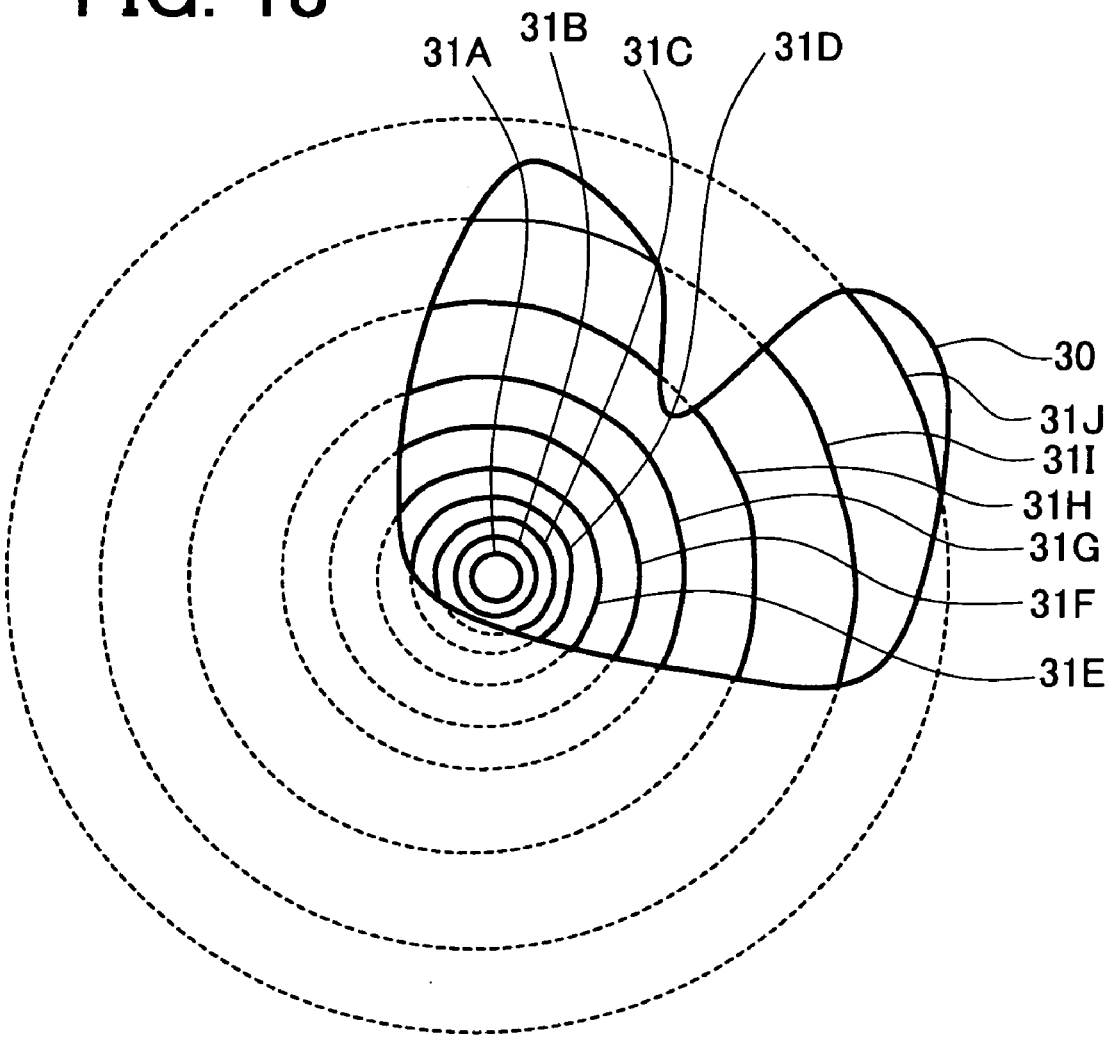
FIG. 18 is an explanatory view which typically illustrates a portion that falls within the embroidery region, extracted from the plurality of circles in the process of creating concentric stitching data according to the first processing method.
Figure 19A:
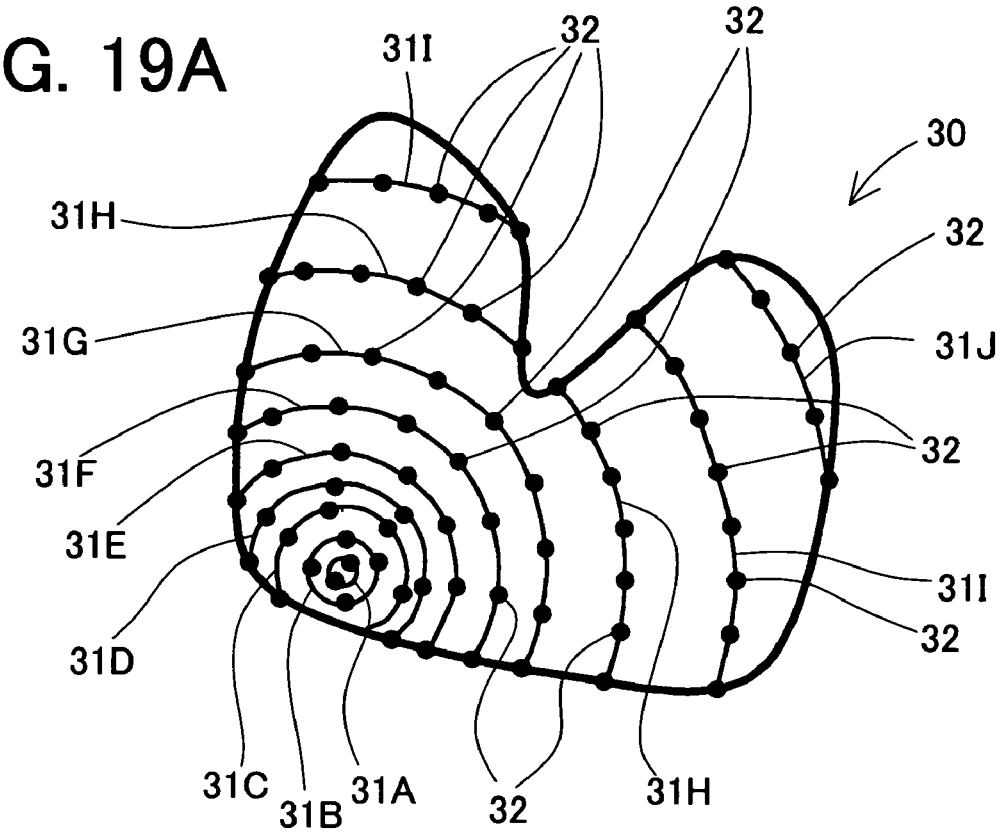
FIG. 19A is an explanatory view which typically illustrates stitch points data created on the circles and arcs extracted in the concentric stitching data.

Then, as for the process of creating concentric stitching data, which is performed in S4 mentioned above, its first processing method is described with reference to FIG. 5. FIG. 5 is a flowchart of a program for the process of creating concentric stitching data according to the first processing method. Referring to FIG. 5, in S10, based on the circle-to-circle spacing change pattern set in the above S3 (S5 to S9), the process executes calculation for creating a plurality of circles 31A to 31J with different radii concentrically around the central point C, as shown in FIG. 17. In the following S11, from the plurality of circles 31, the process extracts the circles 31A, 31B and arcs of 31C to 31J that fall within the embroidery region 30, as shown in FIG. 18. Subsequently, in S12, the process creates stitch points 32 on the circles and arcs extracted in S11, as shown in FIG. 19; thereby, concentric stitching data is created.

Figure 19B:
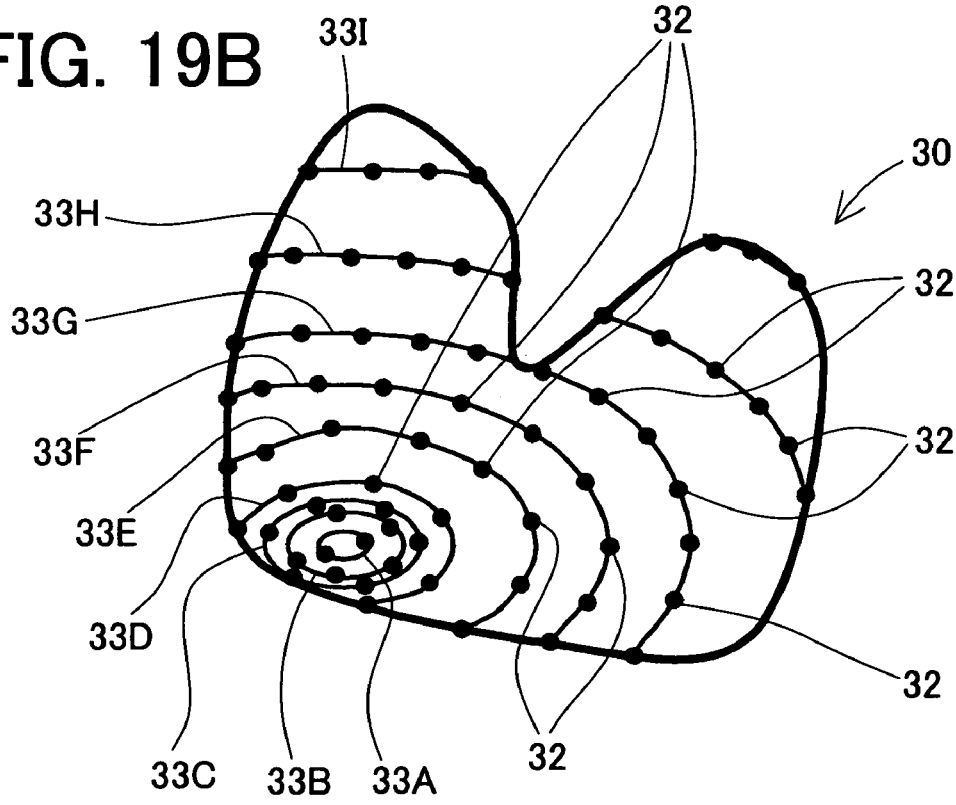
FIG. 19B is an explanatory view which typically illustrates stitch points data created on the ellipses and the curves of ellipse arcs extracted in the concentric stitching data.

In the above process, if the process executes calculation for forming a plurality of ellipses deformed from a plurality of circles with different radii (on the major axis and on the minor axis) concentrically around the central point C, based on the circle-to-circle spacing change pattern in the above S10, extracts the ellipses and arcs that fall within the embroidery region 30 from the plurality of ellipses in the above S11, and in the above S12, creates the stitch points on the ellipses and the curves of the arcs extracted in S11, stitch points 32 are formed on ellipses 33A, 33B, 33C and the arcs of the ellipses 33D to 33I, as shown in FIG. 19B: thereby, elliptic stitching data is created.

Figure 6:
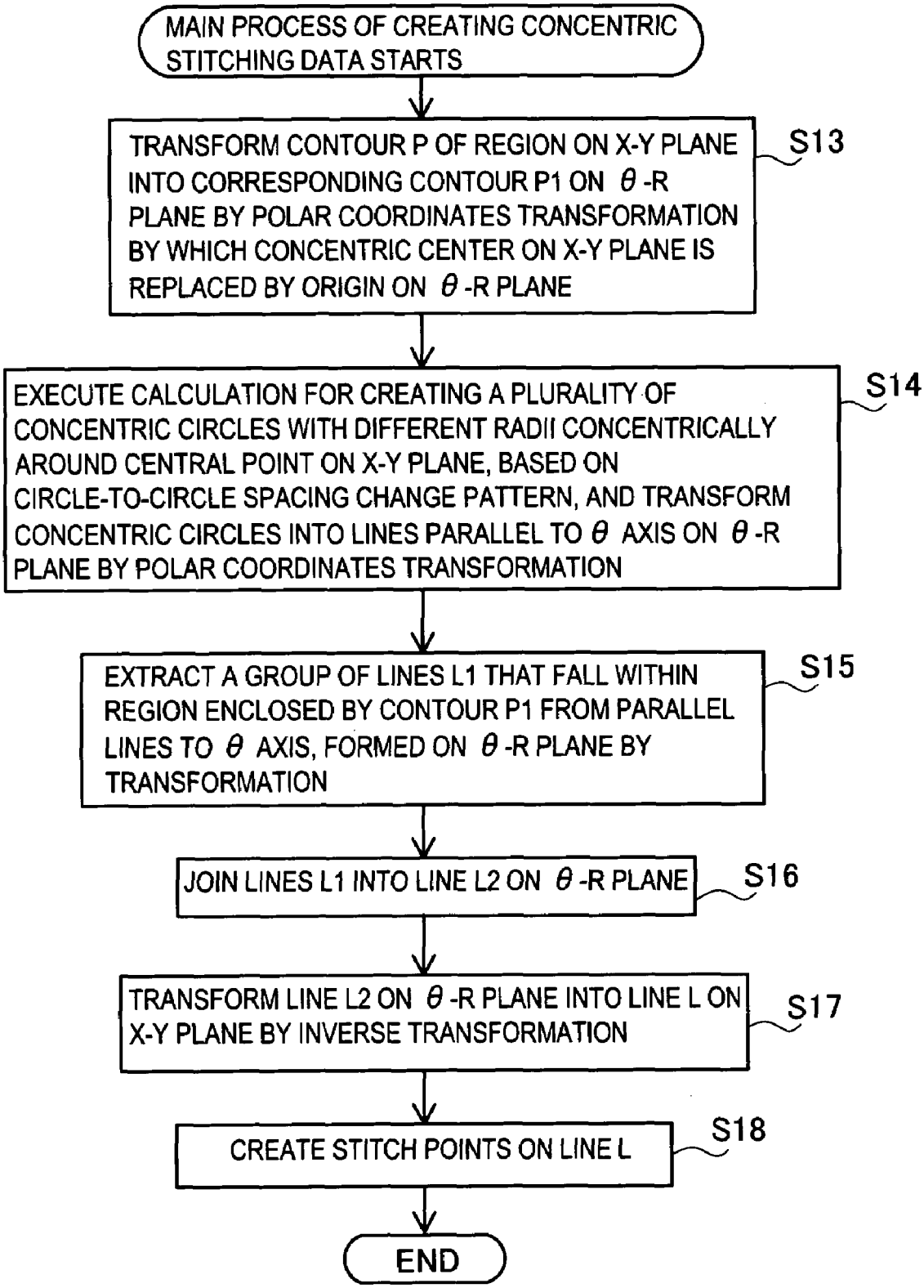
FIG. 6 is a flowchart of a program for a process of creating concentric stitching data according to a second processing method.

Next, as for the process of creating concentric stitching data, which is performed in the above S4, its second processing method that creates concentric stitching data, using transformation of an x-y plane into R-θ and its inverse transformation, is described, based on FIG. 6. FIG. 6 is a flowchart of a program for the process of creating concentric stitching data according to the second processing method.

Figure 20A:
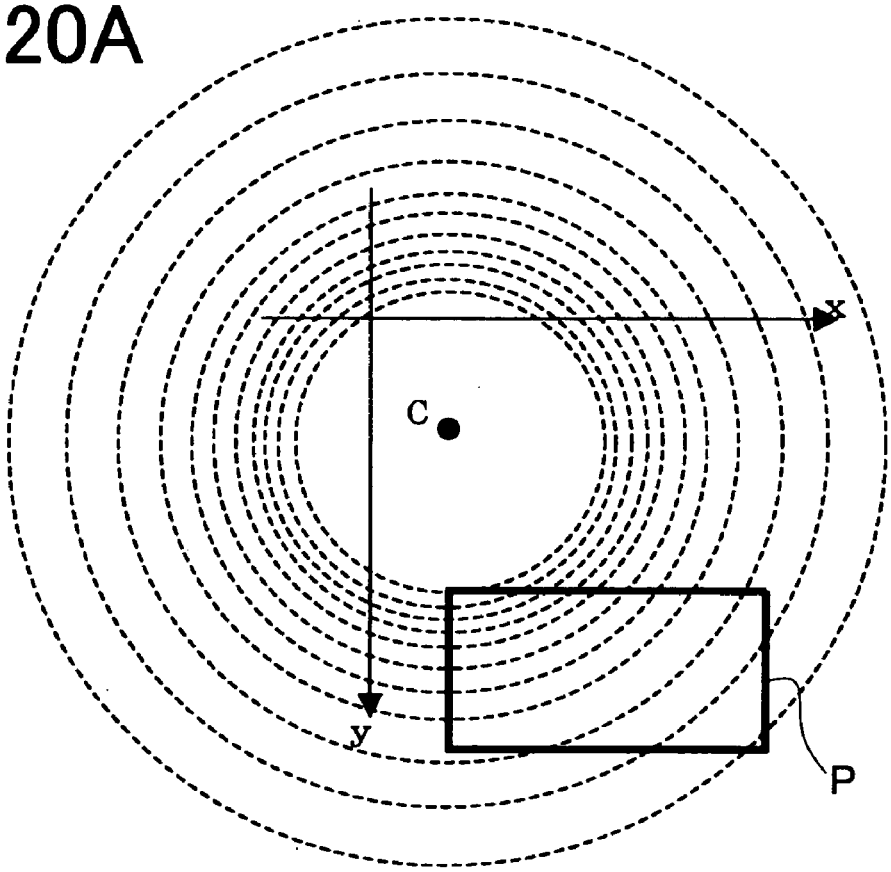
FIG. 20A is an explanatory view which typically illustrates a phase of the process of creating concentric stitching data according to the second processing method and the region contour and concentric circles present on the x-y plane.
Figure 20A:
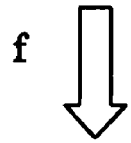
Figure 20B:
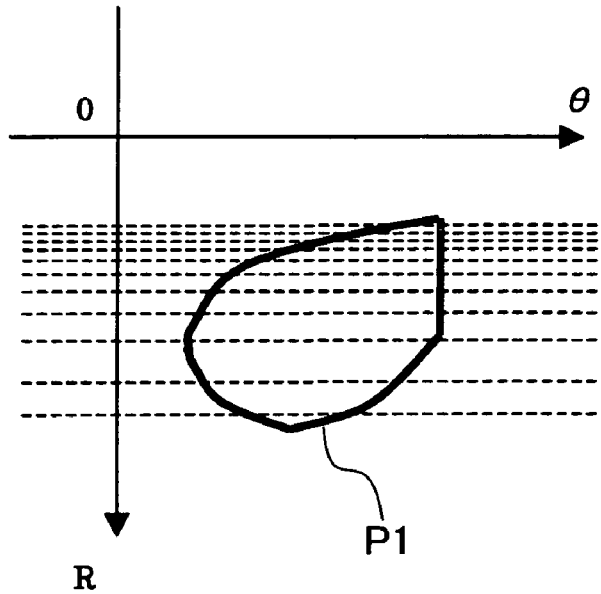
FIG. 20B is an explanatory view which typically illustrates a phase of the process of creating concentric stitching data according to the second processing method and the contour and lines formed on the θ-R plane resulting from polar coordinates transformation of the region contour and concentric circles present on the x-y plane onto the θ-R plane.

Referring to FIG. 6, in S13, the process first transforms a contour P of a region on the x-y plane into a corresponding contour P1 on a θ-R plane by polar coordinates transformation by which the concentric center C on the x-y plane is replaced by a point of origin O on the θ-R plane, as shown in FIGS. 20A and 20B.

Here, the above polar coordinates transformation from the x-y plane to the θ-R plane is executed, according to an equation (1) which is shown in FIG. 35, where θ is defined as an angle formed between the x axis and the line connecting a point (x, y) and the central point C (cx, cy).

In FIG. 35, $f^{-1}$ denotes inverse transformation expressed by $$x=R\times\cos\theta+cx \text{ and } y=R\times\sin\theta+cy.$$

In the following S14, the process executes calculation for creating a plurality of concentric circles with different radii concentrically around the central point C on the x-y plane, based on the above circle-to-circle spacing change pattern, as shown in FIG. 20A, and transforms the plurality of concentric circles into corresponding lines parallel to a θ axis on the θ-R plane (see FIG. 20B) by polar coordinates transformation as described above.

Figure 21A:
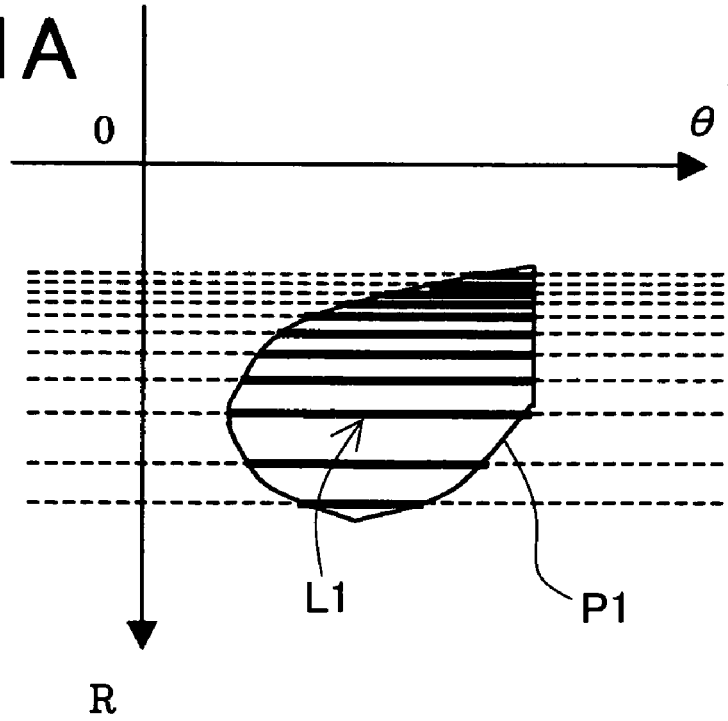
FIG. 21A is an explanatory view which typically illustrates a phase of the process of creating concentric stitching data according to the second processing method and a group of lines falling within the region enclosed by the contour, extracted from the parallel lines to the θ axis on the θ-R plane.

Subsequently, in S15, the process extracts a group of lines L1 that fall within the region enclosed by the contour P1 from the plurality of parallel lines to the θ axis, formed on the θ-R plane by the polar coordinates transformation as above, as shown in FIG. 21A. In S16, the process joins the lines L1 extracted into a line L2 on the θ-R plane, as shown in FIG. 21B.

Figure 22A:
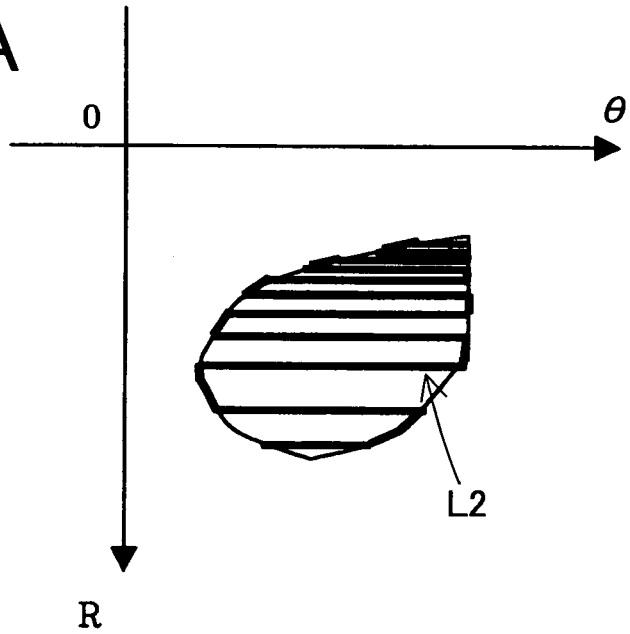
FIG. 22A is an explanatory view which typically illustrates a phase of the process of creating concentric stitching data according to the second processing method and the line obtained on the θ-R plane.
Figure 22B:
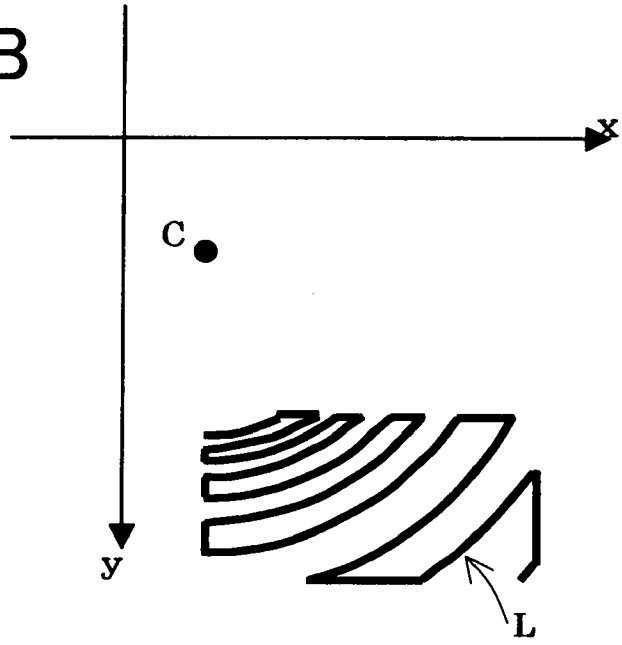
FIG. 22B is an explanatory view which typically illustrates a phase of the process of creating concentric stitching data according to the second processing method and a line obtained by inverse transformation of the line onto the x-y plane.
Figure 22C:
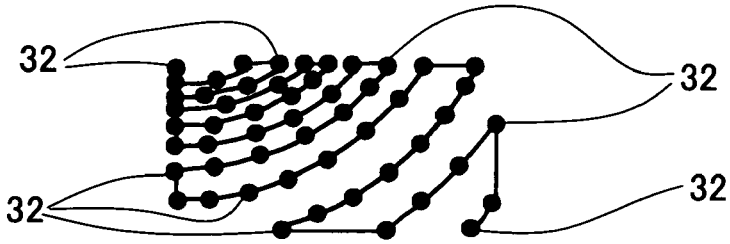
FIG. 22C is an explanatory view which typically illustrates a phase of the process of creating concentric stitching data according to the second processing method and concentric stitching data.

In S17, the process transforms the line L2 (see FIG. 22A) obtained as above on the θ-R plane into a line L on the x-y plane by inverse transformation, as shown in FIG. 22B. In the following step S18, the process creates stitch points 32 on the line L obtained in S17; thereby, concentric stitching data is created, as shown in FIG. 22C.

Figure 7:
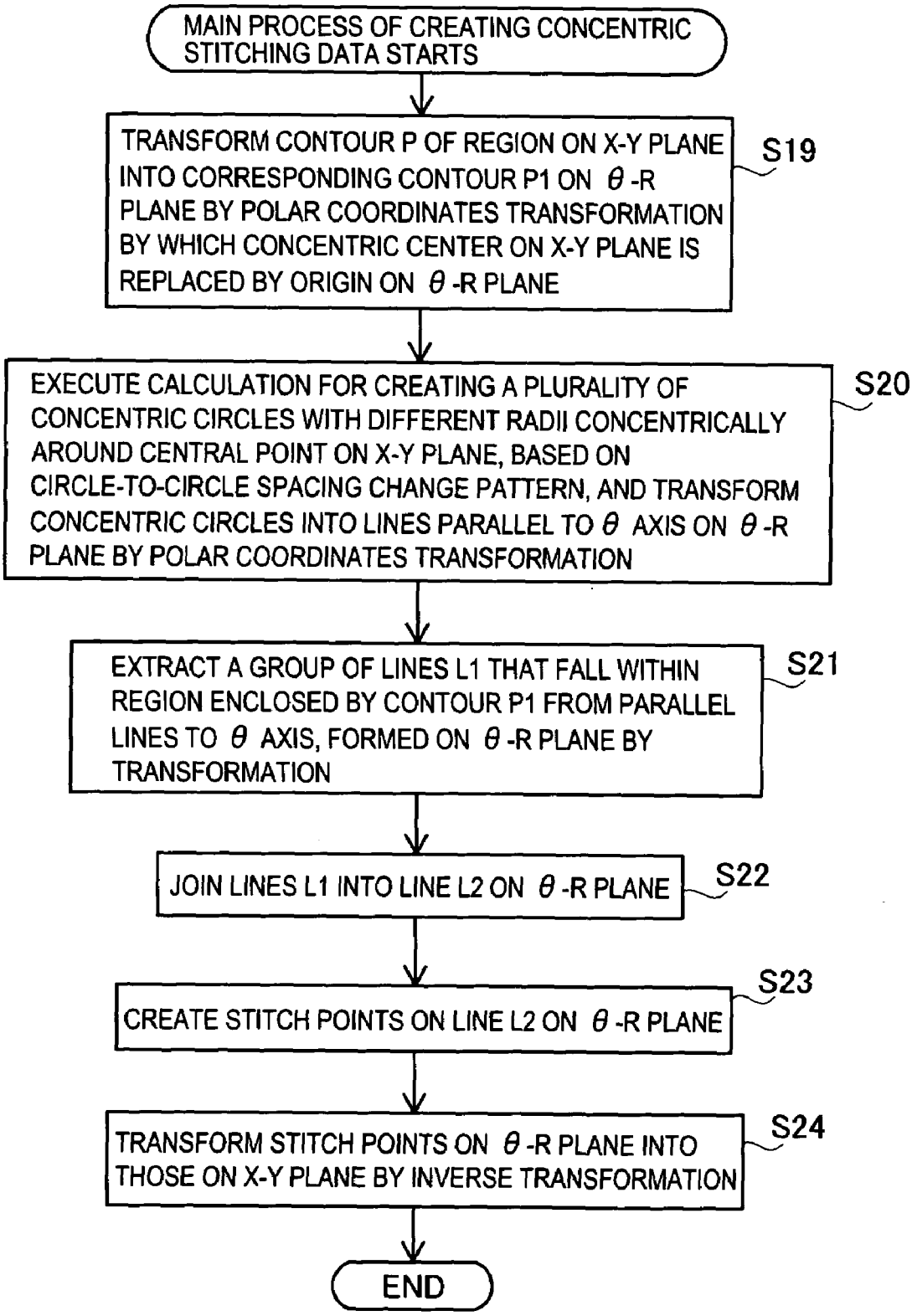
FIG. 7 is a flowchart of a program for a process of creating concentric stitching data according to a third processing method.

Then, a third processing method as an example of modification to the above second processing method is described, with reference to FIG. 7. FIG. 7 is a flowchart of a program for the process of creating concentric stitching data according to the third processing method. Steps S19 to S22 in FIG. 7 are the same as the steps S13 to S16 in FIG. 6 and their explanation is not repeated here.

Figure 21B:
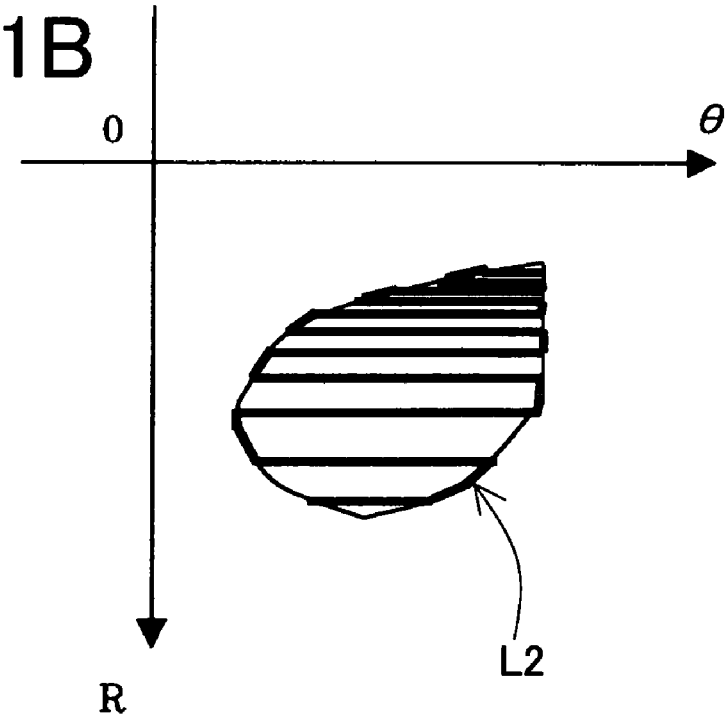
FIG. 21B is an explanatory view which typically illustrates a phase of the process of creating concentric stitching data according to the second processing method and the extracted group of lines joined into a line.
Figure 23A:
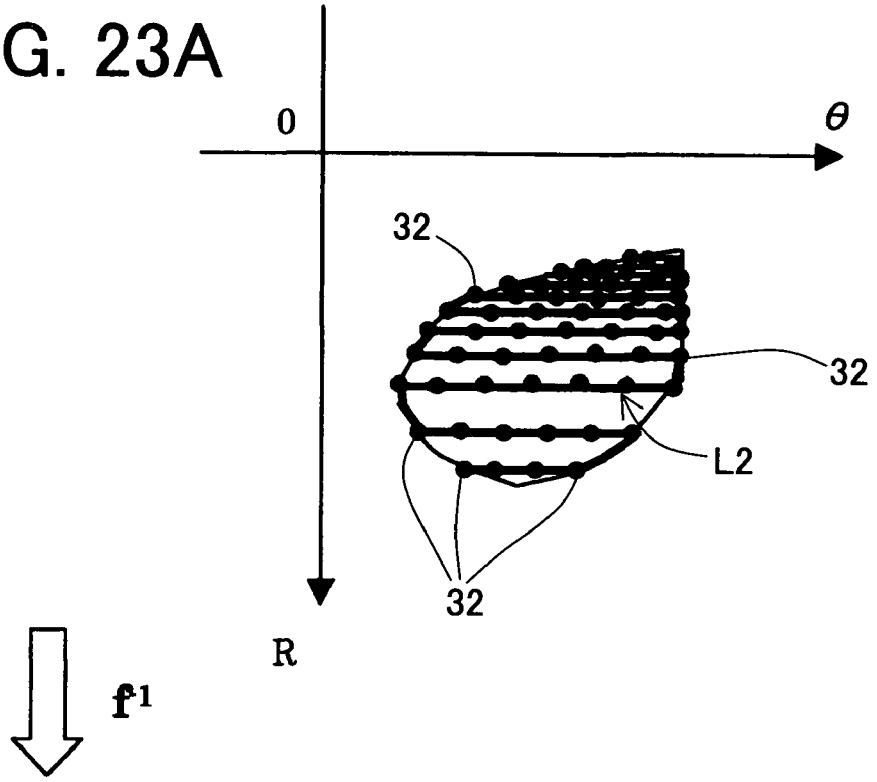
FIG. 23A is an explanatory view which typically illustrates a phase of the process of creating concentric stitching data according to the third processing method and stitch points created on the line obtained on the θ-R plane.
Figure 23B:
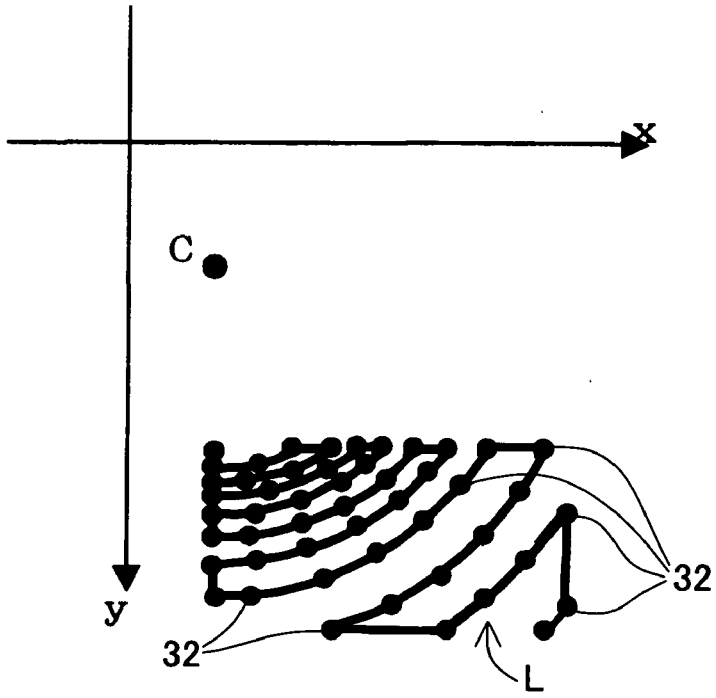
FIG. 23B is an explanatory view which typically illustrates a phase of the process of creating concentric stitching data according to the third processing method and concentric stitching data obtained by inverse transformation of the line with stitch points created thereon onto the x-y plane.

Referring to FIG. 7, when the step S22 has finished, the line L2 into which the lines L1 extracted on the θ-R plane were joined is formed, as shown in FIG. 21B, and then, in S23, the process creates stitch points 32 on the line L2, as shown in FIG. 23A. In S24, the process transforms the line L2 having the stitch points 32 created on the θ-R plane into its correspondent on the-x-y plane by inverse transformation; thereby, concentric stitching data is created, as shown in FIG. 23B.

Figure 8:
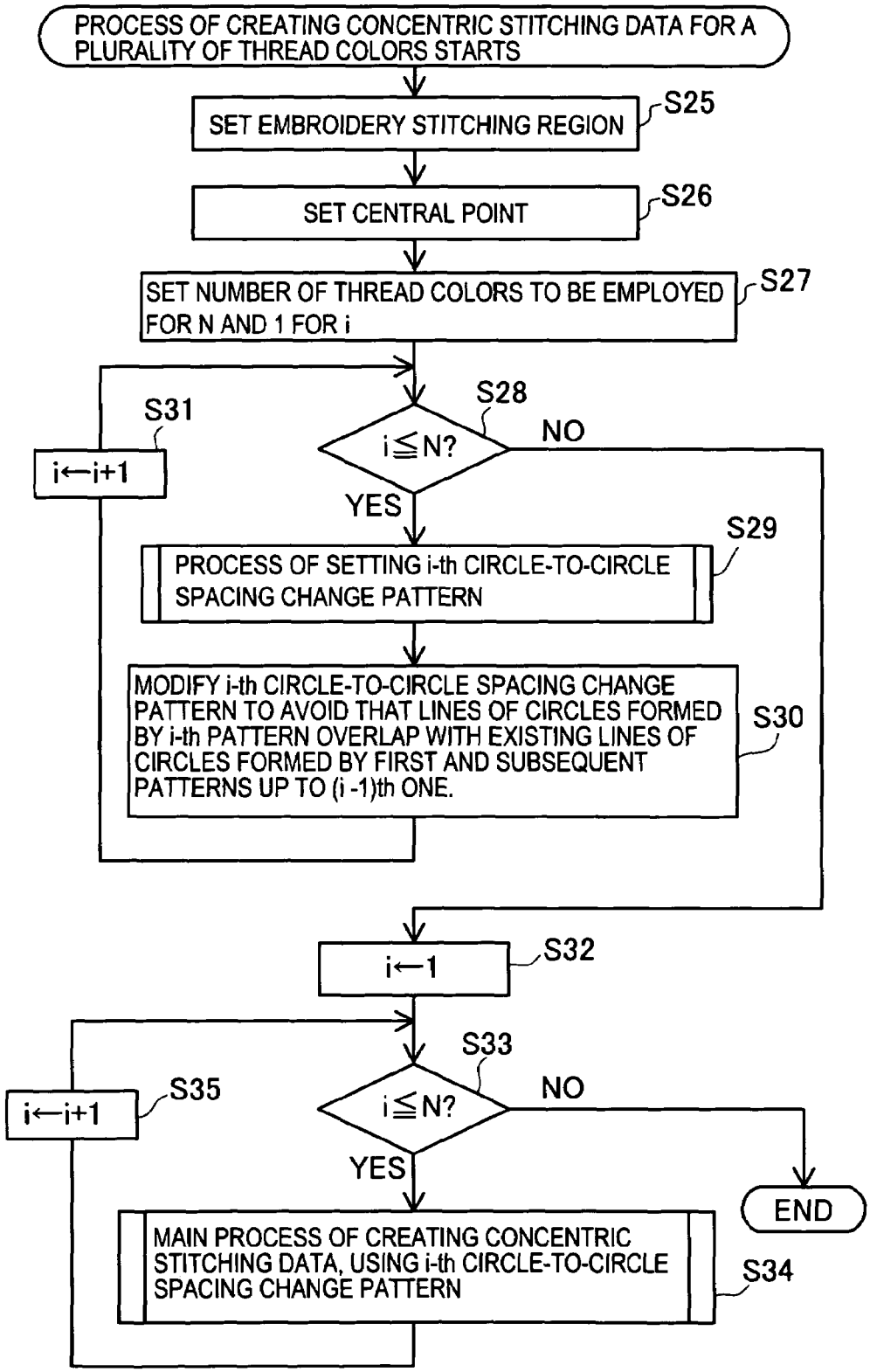
FIG. 8 is a flowchart of a program for a process of creating concentric stitching data according to a fourth processing method.

Next, as for the process of creating concentric stitching data, its fourth processing method that creates concentric stitching data for a plurality of thread colors is described, based on FIG. 8. FIG. 8 is a flowchart of a program for the process of creating concentric stitching data according to the fourth processing method.

Referring to FIG. 8, in S25, first, an embroidery region 30 where embroidering stitches should be formed is set, as is the case in the above S1. In S26, a central point C serving as the reference for forming embroidering stitches within the embroidery region 30 is set, as is the case in the above S2.

In the following S27, the number of thread colors that are actually employed is set for the total number of thread colors N, and 1 is set for the circle-to-circle spacing change pattern number i. In particular, if, for instance, five thread colors are employed, 5 is set for the total number of thread colors N.

In S28, the process determines whether the total number of thread colors N is more than or equal to the circle-to-circle spacing change pattern number i. If a decision at S28 is YES, the process of setting the i-th circle-to-circle spacing change pattern is performed in S29 (the same process as in the above S3, S5 to S9).

Subsequently, in S30, the process modifies the i-th circle-to-circle spacing change pattern to avoid that the lines of circles formed by the i-th pattern overlap with the existing lines of circles formed by the first and subsequent change patterns up to the (i−1)th one.

Figure 24A:
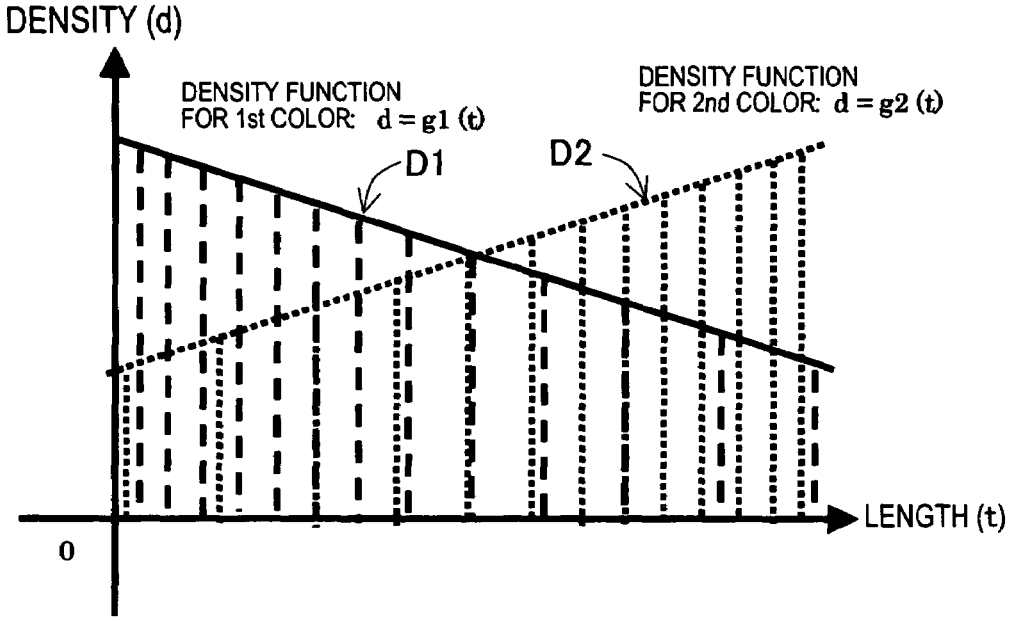
FIG. 24 is an explanatory view which graphically shows modification to a circle-to-circle spacing change pattern when creating stitching data for a plurality of colors.
Figure 24A:
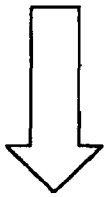

Here, modifying the circle-to-circle spacing change pattern is explained, based on FIG. 24. FIG. 24 graphically describes the modification of a circle-to-circle spacing change pattern when creating stitching data for a plurality of colors. In FIG. 24, two patterns for an instance where stitching data for two colors is created are shown for easiness to understand.

In FIG. 24A, a circle-to-circle spacing change pattern D1 for a first color is denoted by density function d=g1(t) and a circle-to-circle spacing change pattern D2 for a second color is denoted by density function d=g2(t). By comparison of both change patterns D1 and D2, a first color circle line and second color circle line almost overlap each other in the middle section of the both. If the stitching data in this state is used as is, undesirable uneven color mixing occurs.

Figure 24B:
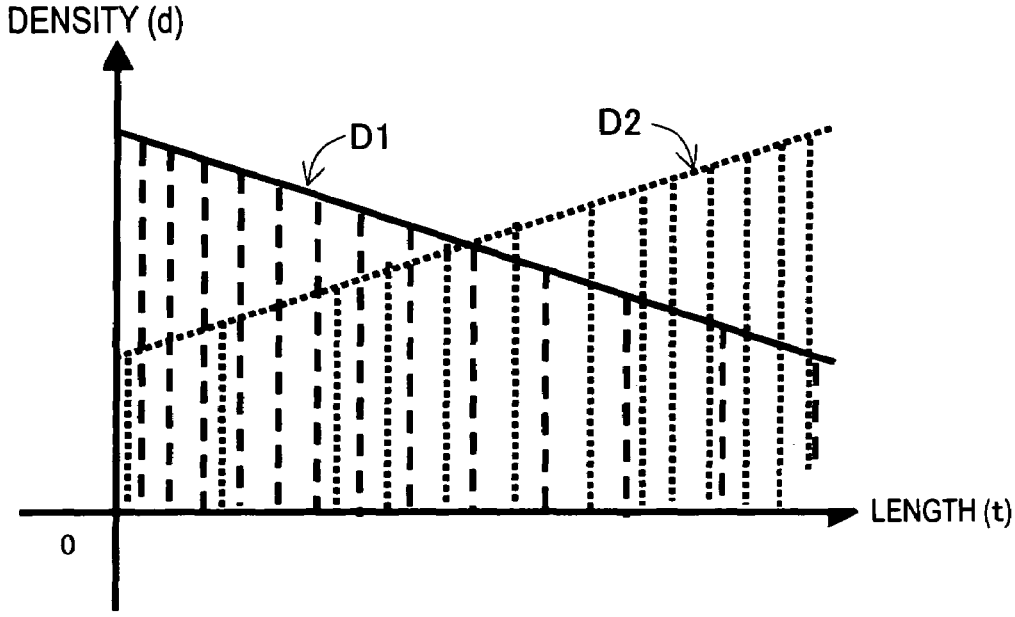

Thus, the circle-to-circle spacing change pattern for the second color is modified to shift so that the lines of circles created based on the circle-to-circle spacing change pattern D1 for the first color and the lines of circles created based on the circle-to-circle spacing change pattern D2 for the second color do not overlap, as shown in FIG. 24B.

Subsequently, in S31, the circle-to-circle spacing change pattern number is incremented by one and the process returns to S28. After the circle-to-circle spacing change pattern number is incremented by one, if the decision at S28 is YES, the steps S29 and S30 are executed again, the circle-to-circle spacing change pattern number is incremented by one at S31, and the process returns to S28 again. It is assumed that one circle-to-circle spacing change pattern exists for each thread color and, therefore, if, for instance, two thread colors are employed, the steps S29 and S30 are repeated twice and the process returns to S28.

As the result of incrementing the circle-to-circle spacing change pattern number by one as above, if the decision at S28 is NO, the process goes to S32 and the process of creating concentric stitching data is performed per each circle-to-circle spacing change pattern.

Specifically, at S32, 1 is set for the circle-to-circle spacing change pattern number i and, at S33, the process determines whether the total number of thread colors N is more than or equal to the circle-to-circle spacing change pattern number i. If the decision at S33 is YES, the process creates stitches on concentric circles, using the i-th circle-to-circle spacing change pattern in S34. This process of creating stitches is the same as the above-described process (see the main process of creating concentric stitching data in FIG. 5 or 6 or 7). Subsequently, in S35, the circle-to-circle spacing change pattern number i is incremented by one and the process returns to step S33. As is the case in the above S28, if, for instance, two thread colors are employed, the step S34 is repeated twice and the process returns to S33. As the result of incrementing the circle-to-circle spacing change pattern number by one, if the decision at S33 is NO, the concentric stitching data creation process terminates.

Figure 25A:
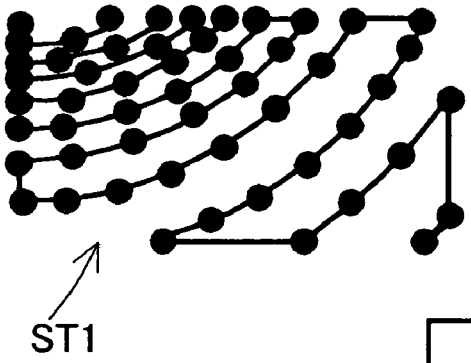
FIG. 25A is an explanatory view which typically illustrates a phase of the process of creating concentric stitching data according to the fourth processing method and concentric stitching data for a first color.
Figure 25B:
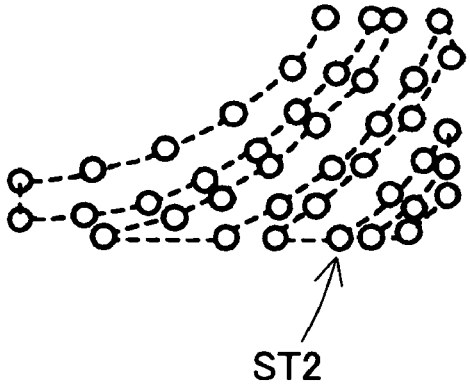
FIG. 25B is an explanatory view which typically illustrates a phase of the process of creating concentric stitching data according to the fourth processing method and concentric stitching data for a second color.
Figure 25C:
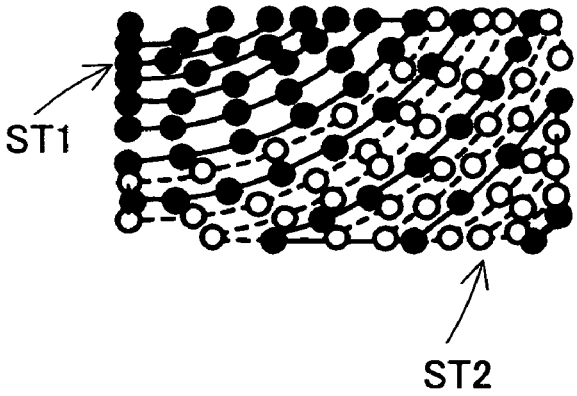
FIG. 25C is an explanatory view which typically illustrates a phase of the process of creating concentric stitching data according to the fourth processing method and concentric stitching data composed of both stitching data for the first and second colors.

Now, the process in the above S34 is explained concretely, based on FIG. 25. In FIG. 25, stitching data ST1 for the first color is shown in FIG. 25A and stitching data ST2 for the second color is shown in FIG. 25B. Here, the stitching data for the second color is created not to overlap with the stitching data ST1 for the first color through the above steps S29 and S30. Thus, when both stitching data ST1 and ST2 are combined, the colors can be mixed in a balanced manner, avoiding that both stitching data ST1 and ST2 overlap each other, as shown in FIG. 25C.

The density of the lines of circles formed by the circle-to-circle spacing change pattern D1 for the first color gradually (monotonously) changes from dense spacing to sparse spacing, as the distance (or radius) from the central point increases. On the other hand, the density of the lines of circles formed by the circle-to-circle spacing change pattern D2 for the second color gradually (monotonously) changes from sparse spacing to dense spacing, as the distance (or radius) from the central point increases, as shown in FIG. 24B. In this way, it is seen that the circle-to-circle spacing change pattern D1 for the first color and the circle-to-circle spacing change pattern D2 for the second color are in inverse relation.

Figure 9:
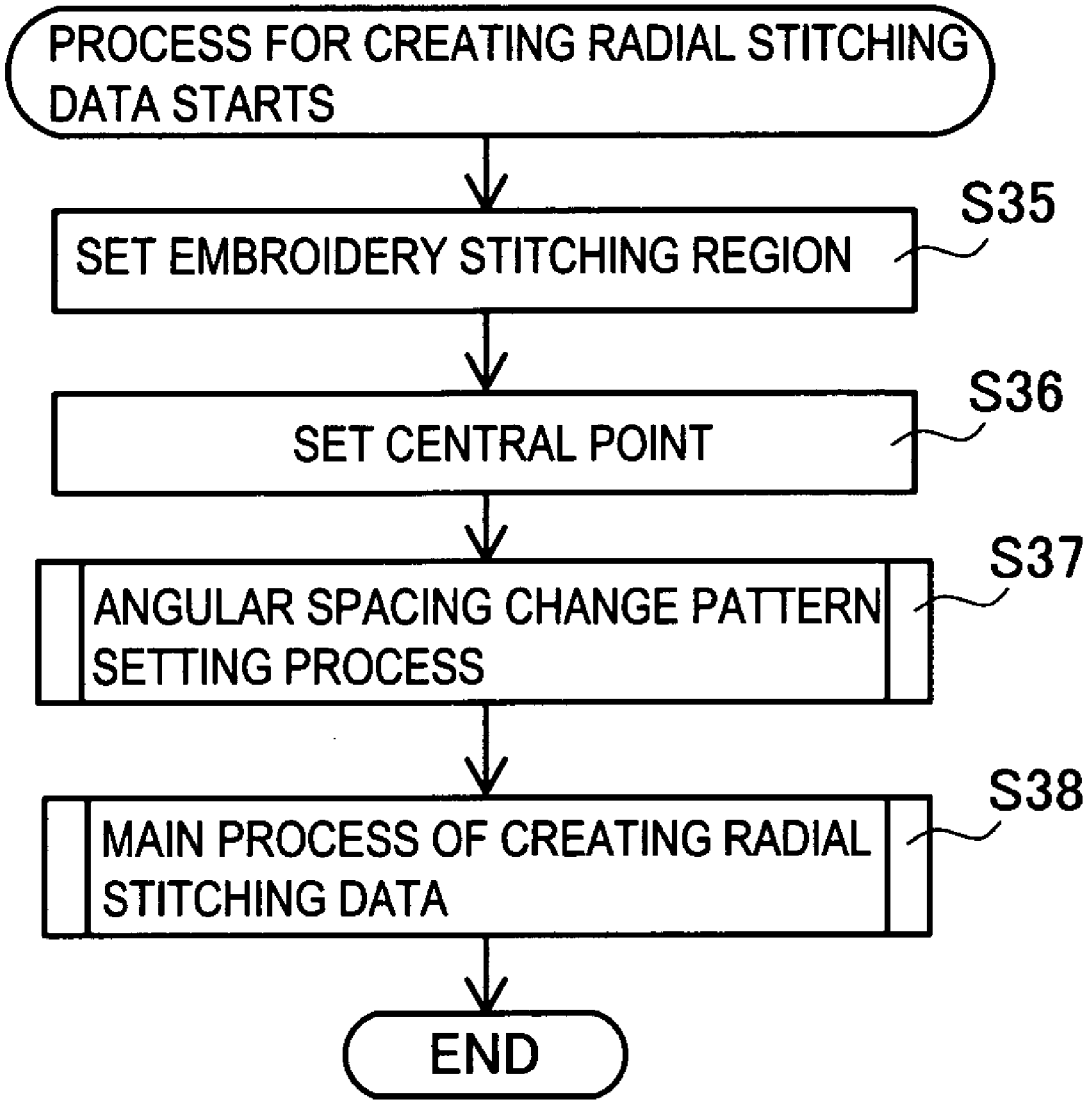
FIG. 9 is a flowchart of a program for a process for creating radial stitching data.

Next, a process for creating radial stitching data is described, based mainly on FIG. 9. FIG. 9 is a flowchart of a program for the process for creating radial stitching data.

Referring to FIG. 9, in S35, first, an embroidery region 30 where embroidering stitches should be formed is set (see FIG. 15) and, in the following S36, a central point C serving as the reference for forming embroidering stitches within the embroidery region 30 is set (see FIG. 15), as is the case in the above S1 and S2.

In S37, as will be detailed below, a process of setting an angular spacing change pattern in which angular spacing between adjacent half lines of a plurality of half lines radiating from the central point C at different angles relative to a predetermined reference direction will change in a rotation around the central point is performed. Furthermore, in S38, a process of creating radial stitching data (which will be described later) is performed.

Figure 10:
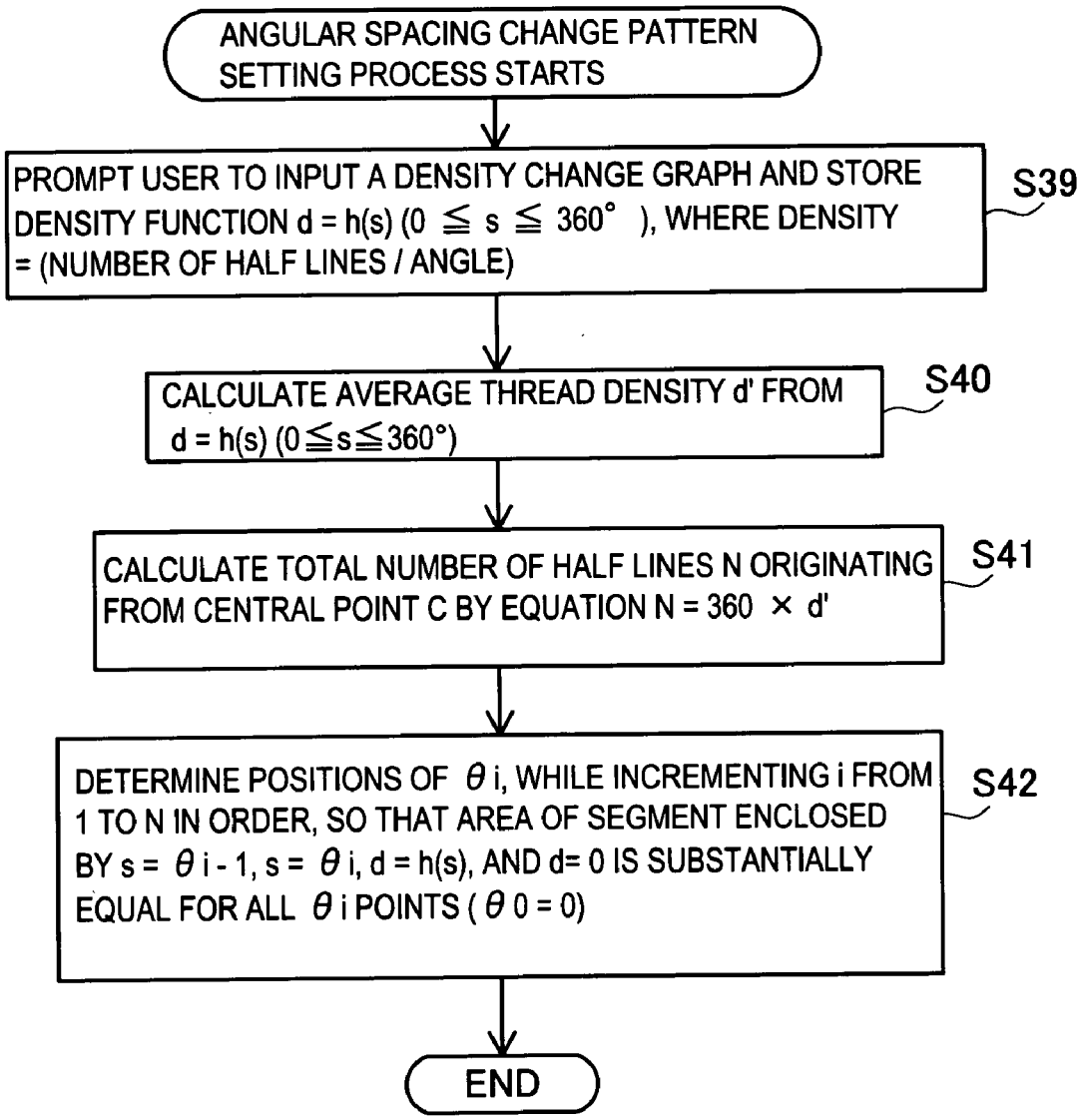
FIG. 10 is a flowchart of a program for an angular spacing change pattern setting process.

Then, the angular spacing change pattern setting process which is performed in the above S37 is described, based on FIG. 10. FIG. 10 is a flowchart of a program for the angular spacing change pattern setting process. Referring to FIG. 10, in S39, the process prompts the user to input a density change graph by means of the keyboard 5 and stores a density function d=h(s) (where $0 \leqq s \leqq 360$ degrees) obtained from the user-specified density change graph into the RAM 24. Here, the density is defined as $$\text{Density}=(\text{Number of half lines/angle}).$$

Figure 26:
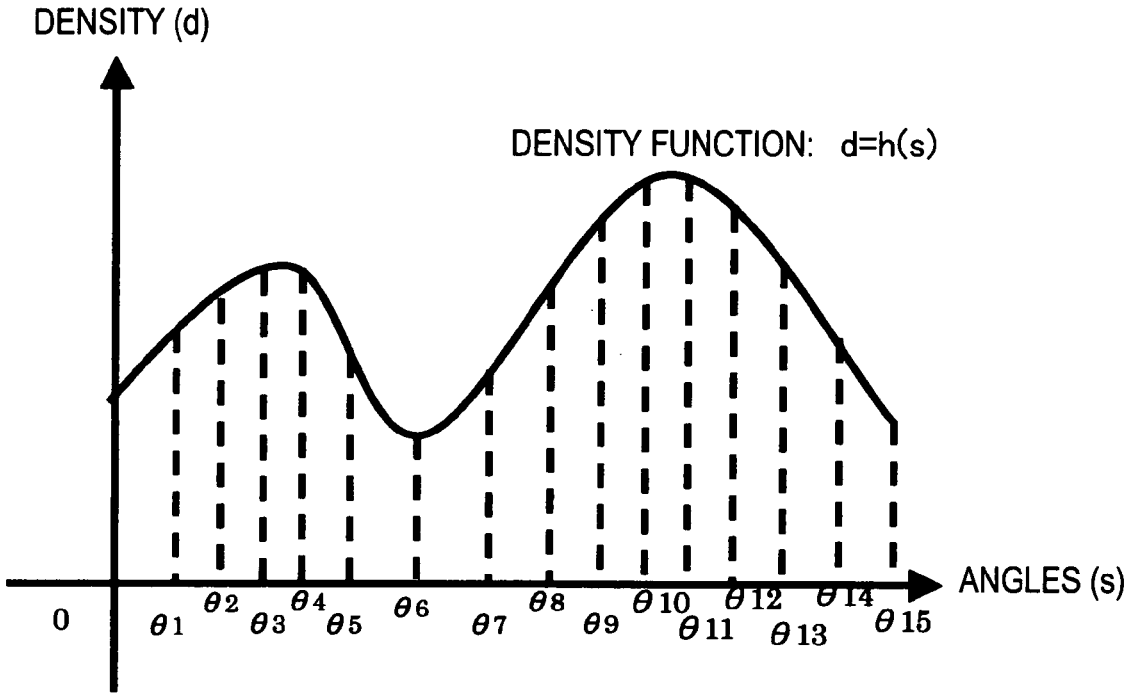
FIG. 26 is a graph representing an angular spacing change pattern.

Next, in S40, the process calculates average thread density d' from the density function d=h(s) (where $0 \leqq s \leqq 360$ degrees) and, in S41, calculates the total number of half lines N originating from the central point C by equation $N=360 \times d'$. In S42, the process determines positions of $\theta i$, while incrementing i from 1 to N in order, so that the area of a segment enclosed by $s=\theta i-1$, $s=\theta i$, d=h(s), and d=0 is substantially equal for all $\theta i$ points, where $\theta 0=0$. Thereby, an angular spacing change pattern is set, as shown in FIG. 26. FIG. 26 is a graph representing an angular spacing change pattern with density (d) on the ordinate and angles (s) on the abscissa.

Figure 11:
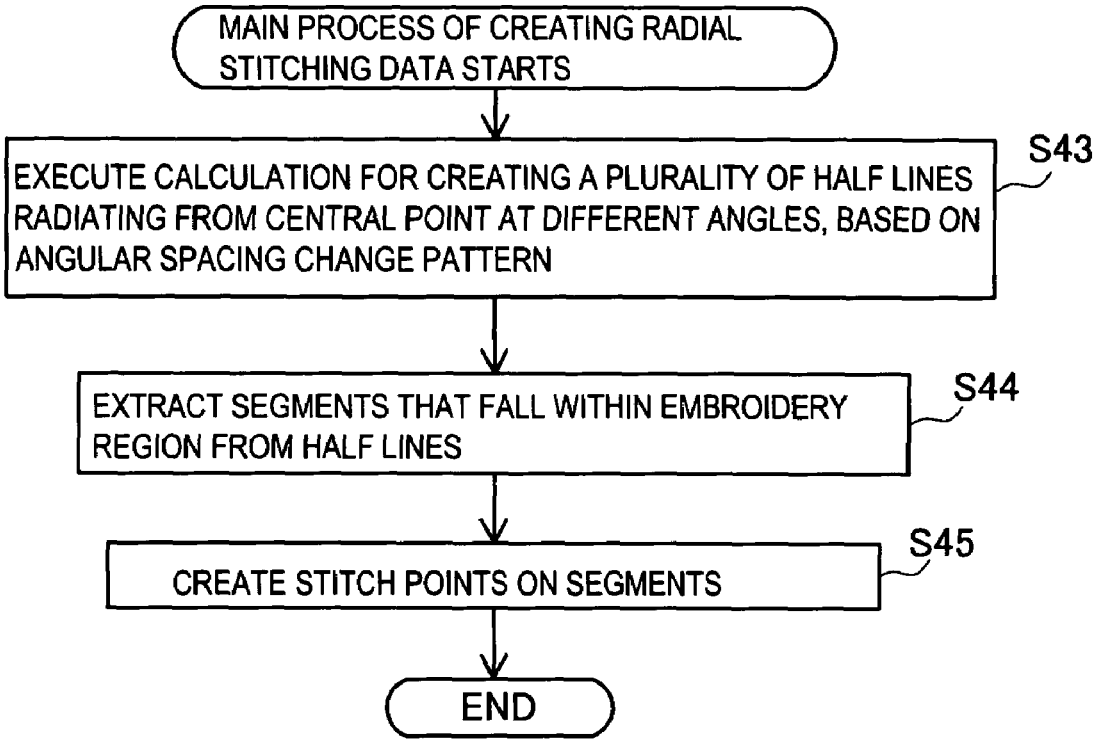
FIG. 11 is a flowchart of a program for a process of creating radial stitching data according to a first processing method.
Figure 27:
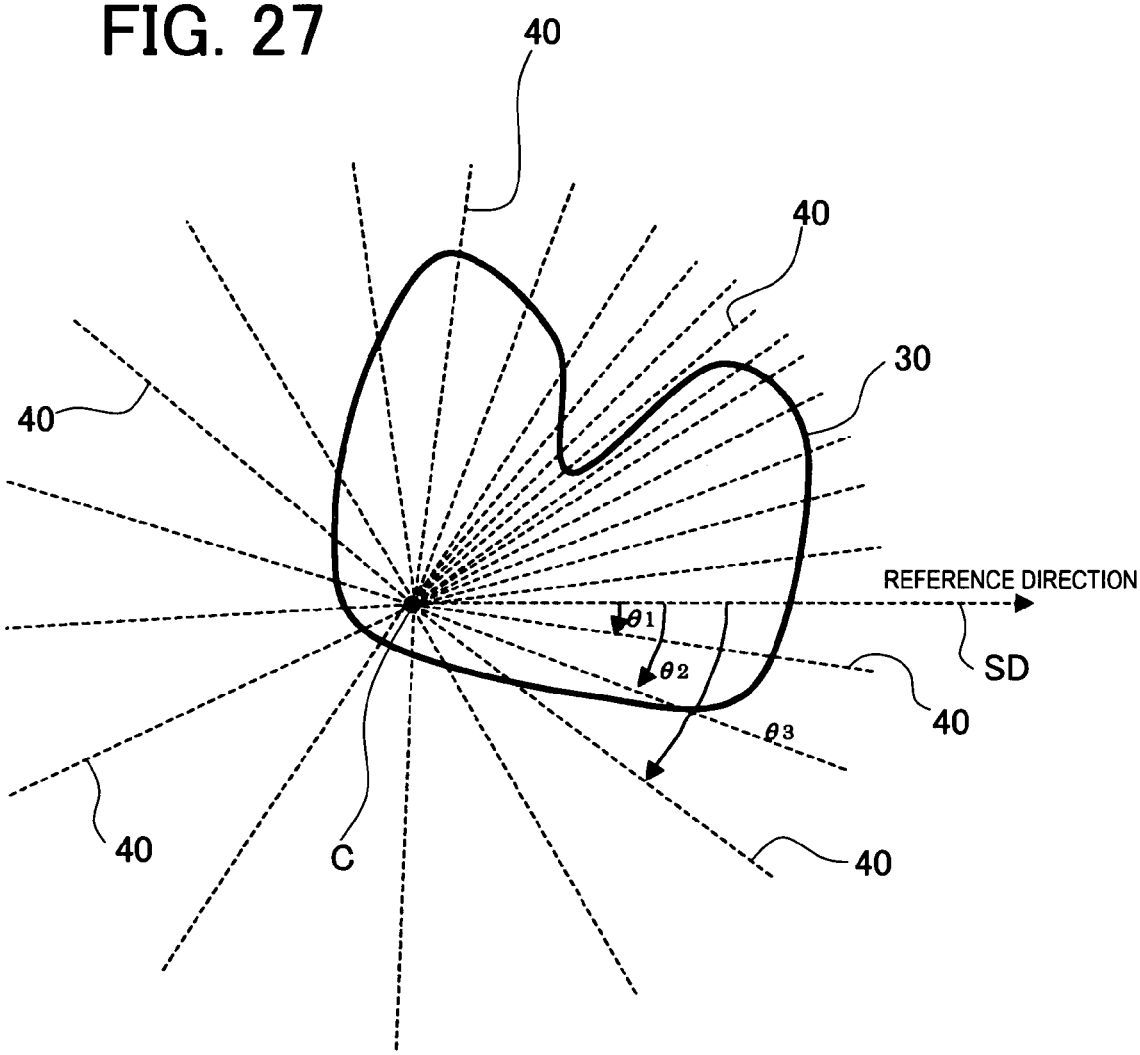
FIG. 27 is an explanatory view which typically illustrates the relation between the embroidery region and a plurality of half lines radiating from the central point at different angles in the process of creating radial stitching data according the first processing method.
Figure 28:
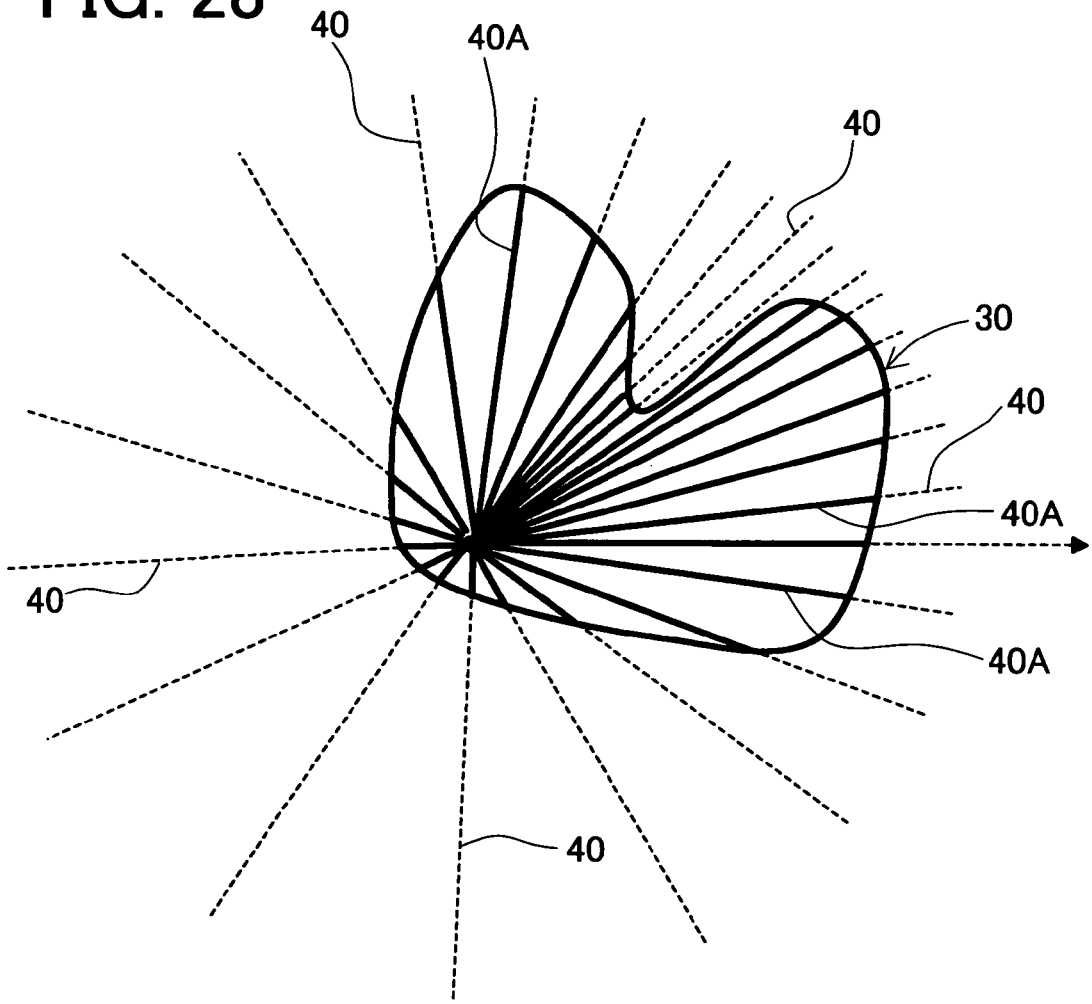
FIG. 28 is an explanatory view which typically illustrates the segments that fall within the embroidery region extracted from the half lines in the process of creating radial stitching data according the first processing method.
Figure 29:
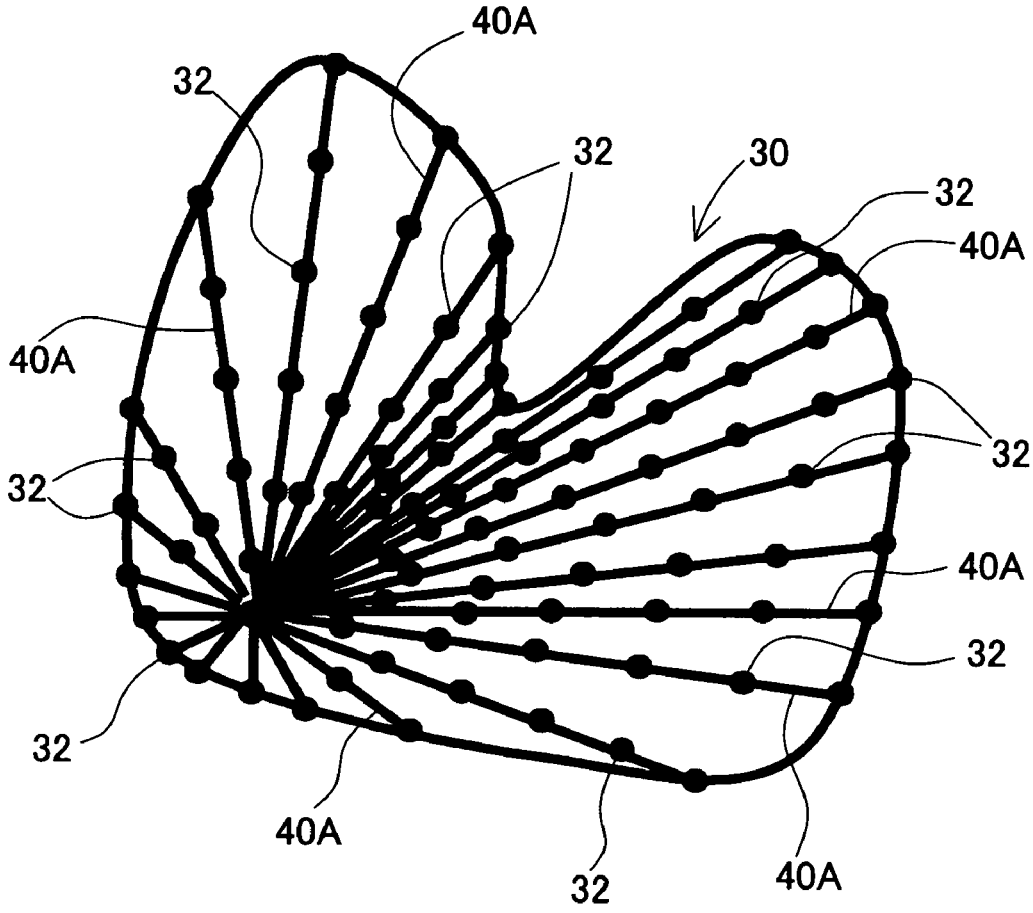
FIG. 29 is an explanatory view which typically illustrates stitch points created on the extracted segments of the half lines in the process of creating radial stitching data according the first processing method.

Then, as for the process of creating radial stitching data, which is performed in the above S38, its first processing method is described, based on FIG. 11. FIG. 11 is a flowchart of a program for the process of creating radial stitching data according to the first processing method. Referring to FIG. 11, in S43, based on the angular spacing change pattern set in the above S37 (S39 to S42), the process executes calculation for creating a plurality of half lines 40 radiating from the central point C at different angles, as shown in FIG. 27. In the following S44, the process extracts segments 40A that fall within the embroidery region 30 from the half lines 40, as shown in FIG. 28. Subsequently, in S45, as shown in FIG. 29, the process creates stitch points 32 on the segments 40A extracted in S44; thereby, radial stitching data is created.

Figure 12:
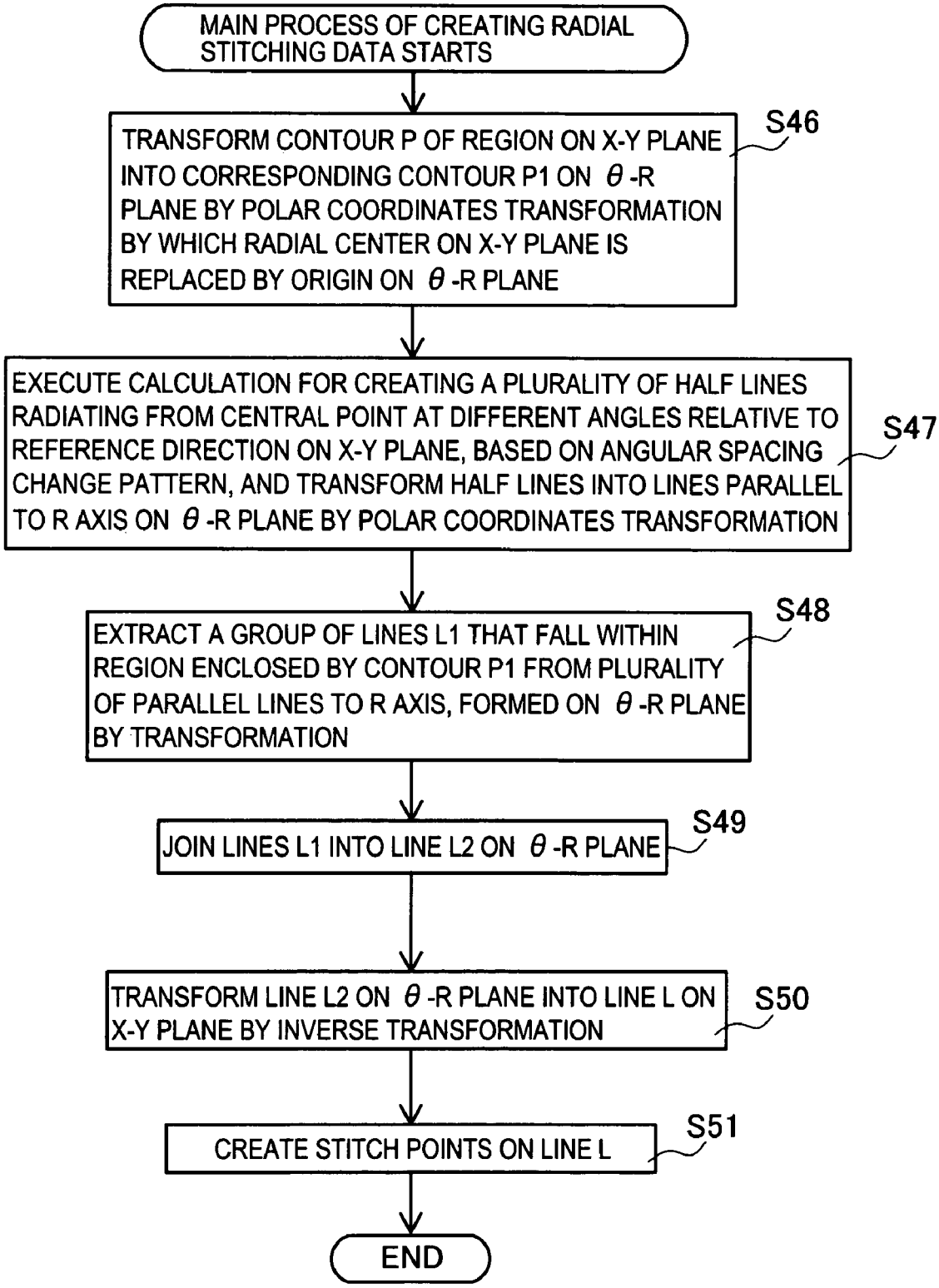
FIG. 12 is a flowchart of a program for a process of creating radial stitching data according to a second processing method.

Next, as for the process of creating radial stitching data, which is performed in the above S38, its second processing method that creates radial stitching data, using transformation of an x-y plane into R-$\theta$ and its inverse transformation, is described with reference to FIG. 12. FIG. 12 is a flowchart of a program for the process of creating radial stitching data according to the second processing method.

Figure 30A:
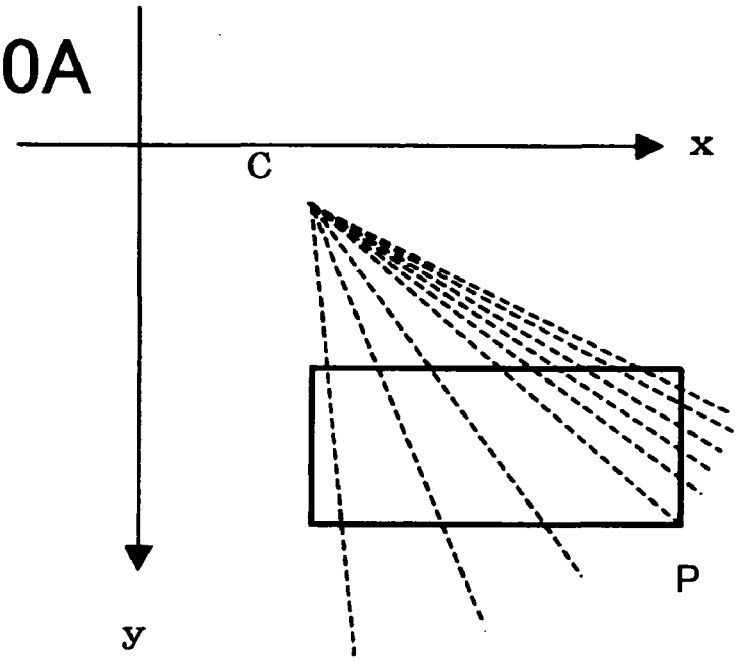
FIG. 30A is an explanatory view which typically illustrates a phase of the process of creating radial stitching data according to the second processing method and a plurality of half lines radiating from the central point at different angles, created by calculation on the x-y plane.
Figure 30A:
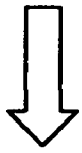
Figure 30B:
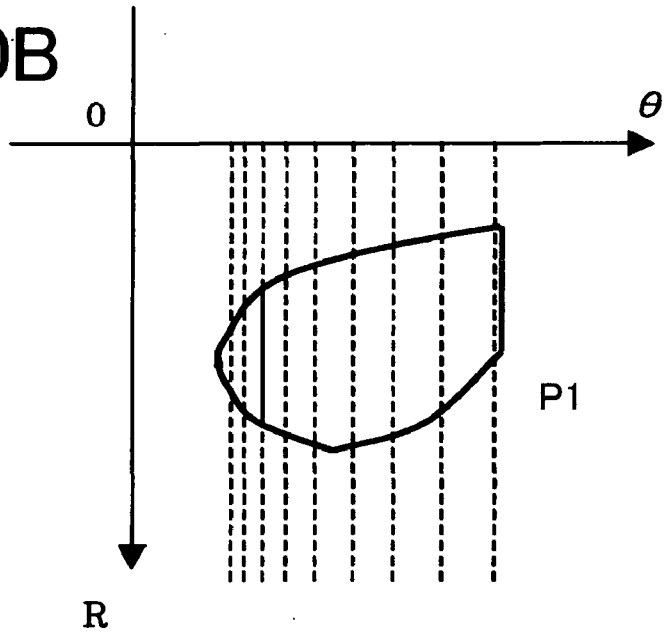
FIG. 30B is an explanatory view which typically illustrates a phase of the process of creating radial stitching data according to the second processing method and transformation of the plurality of half lines into lines parallel to the R axis on the θ-R plane by polar coordinates transformation.

Referring to FIG. 12, in S46, first, the process transforms a contour P of a region on the x-y plane into a corresponding contour P1 on a $\theta$-R plane by polar coordinates transformation by which the radial center C on the x-y plane is replaced by a point of origin O on the $\theta$-R plane, as shown in FIGS. 30A and 30B.

Here, the above polar coordinates transformation from the x-y plane to the $\theta$-R plane is executed, according to equation (1) which is shown in FIG. 35, where $\theta$ is defined as an angle formed between the x axis and the line connecting a point (x, y) and the central point C (cx, cy), as noted in the foregoing.

In FIG. 35, $f^{-1}$ denotes inverse transformation expressed by $$x=R\times\cos\theta+cx \text{ and } y=R\times\sin\theta+cy.$$

In the following S47, the process executes calculation for creating a plurality of half lines 40 radiating from the central point C at different angles relative to the reference direction SD (see FIG. 27) on the x-y plane, based on the above angular spacing change pattern, as shown in FIG. 30A, and transforms the plurality of half lines 40 into corresponding lines parallel to the R axis on the $\theta$-R plane (see FIG. 30B) by polar coordinates transformation as described above.

Figure 31A:
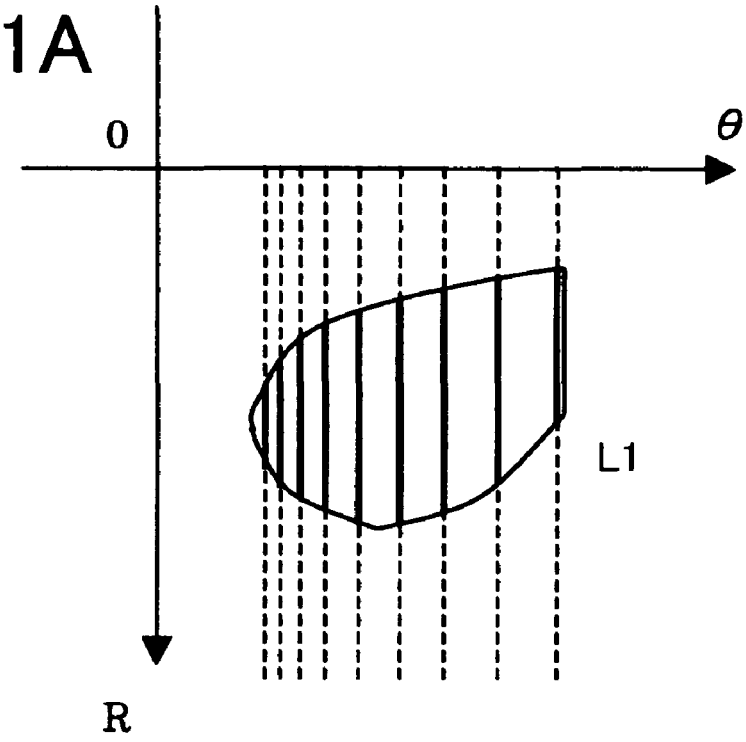
FIG. 31A is an explanatory view which typically illustrates a phase of the process of creating radial stitching data according to the second processing method and a group of lines falling within the region enclosed by contour, extracted from the parallel lines to the R axis on the θ-R plane.

Subsequently, in S48, the process extracts a group of lines L1 that fall within the region enclosed by the contour P1 from the plurality of lines parallel to the R axis, formed on the $\theta$-R plane by the polar coordinates transformation as above, as shown in FIG. 31A. In S49, the process joins the lines L1 extracted into a line L2 on the $\theta$-R plane, as shown in FIG. 31B.

Figure 32A:
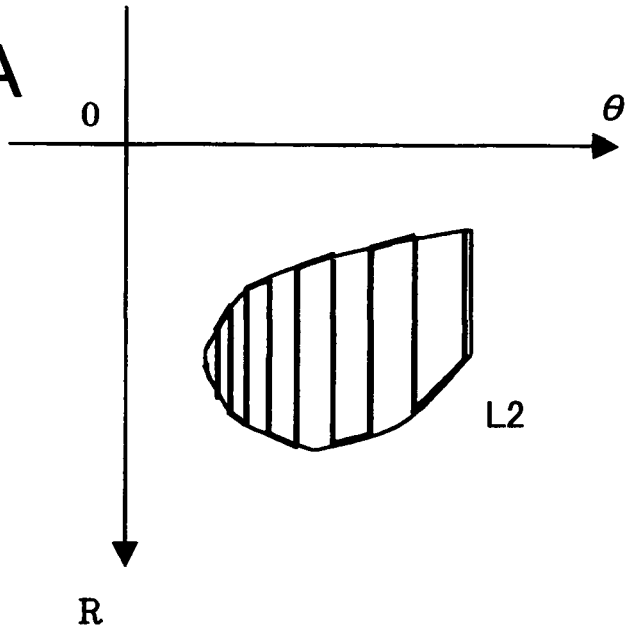
FIG. 32A is an explanatory view which typically illustrates a phase of the process of creating radial stitching data according to the second processing method and a line obtained by joining the group of lines together on the θ-R plane.
Figure 32B:
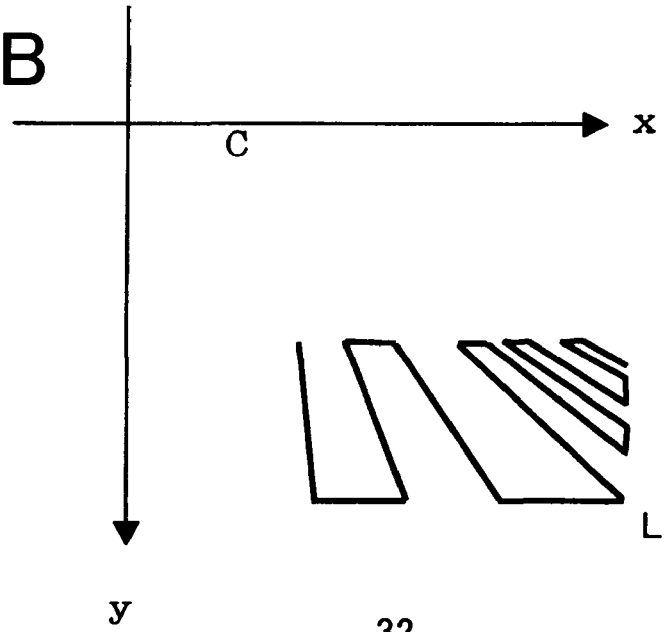
FIG. 32B is an explanatory view which typically illustrates a phase of the process of creating radial stitching data according to the second processing method and a line obtained by inverse transformation of the line onto the x-y plane.
Figure 32C:
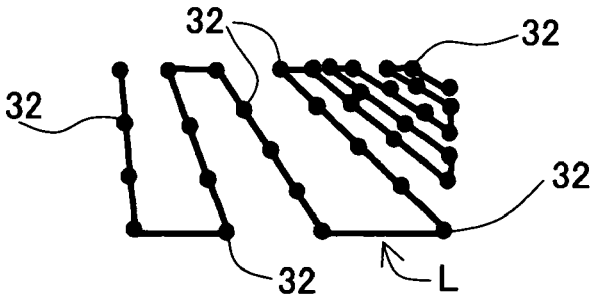
FIG. 32C typically illustrates a phase of the process of creating radial stitching data according to the second processing method and radial stitching data.

In S50, the process transforms the line L2 (see FIG. 32A) obtained as above on the θ-R plane into a line L on the x-y plane by inverse transformation, as shown in FIG. 32B. In the following step S51, the process creates stitch points 32 on the line L obtained in S50; thereby, radial stitching data is created, as shown in FIG. 32C.

Figure 13:
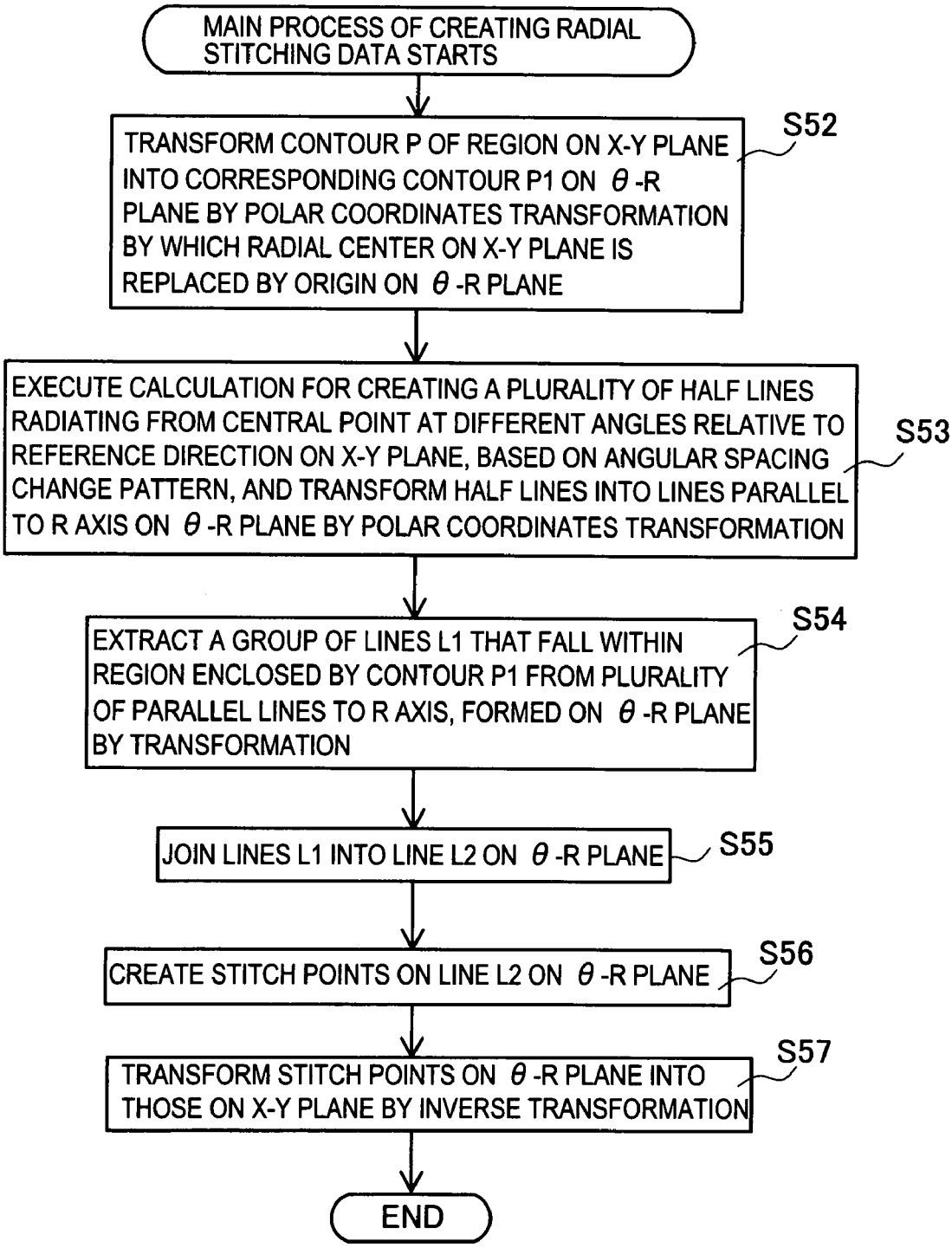
FIG. 13 is a flowchart of a program for a process of creating radial stitching data according to a third processing method.

Then, a third processing method as an example of modification to the above second processing method is described, with reference to FIG. 13. FIG. 13 is a flowchart of a program for the process of creating radial stitching data according to the third processing method. Steps S52 to S55 in FIG. 13 are the same as the steps S46 to S49 in FIG. 12 and their explanation is not repeated here.

Figure 31B:
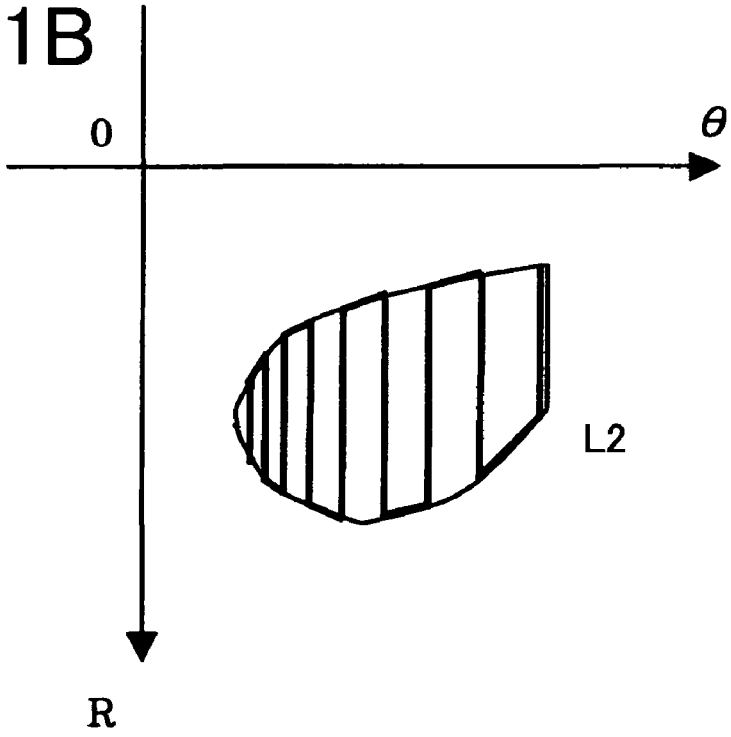
FIG. 31B is an explanatory view which typically illustrates a phase of the process of creating radial stitching data according to the second processing method and the group of lines joined into a line on the θ-R plane.
Figure 33A:
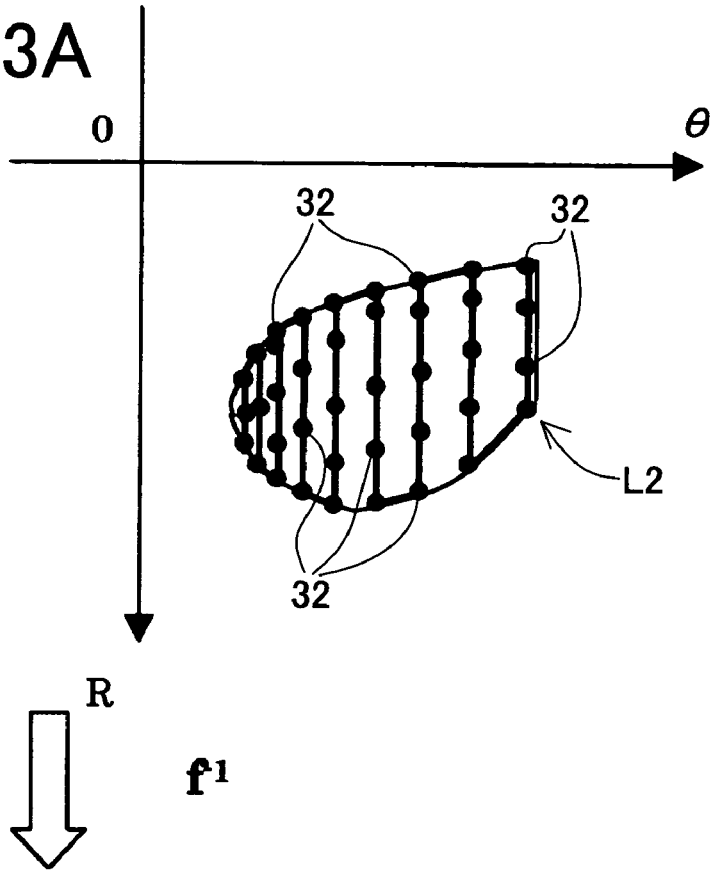
FIG. 33A is an explanatory view which typically illustrates a phase of the process of creating radial stitching data according to the third processing method as an example of modification to the second processing method and stitch points created on the line obtained on the θ-R plane.
Figure 33B:
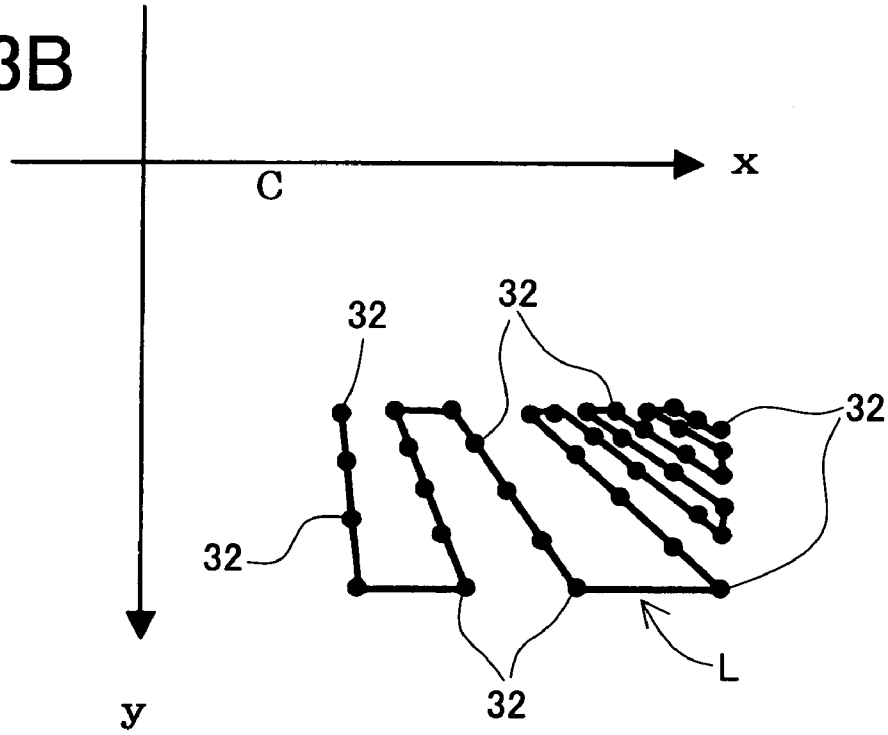
FIG. 33B is an explanatory view which typically illustrates a phase of the process of creating radial stitching data according to the third processing method as an example of modification to the second processing method and radial stitching data obtained by inverse transformation of the line with stitch points onto the x-y plane.
Figure 34A:
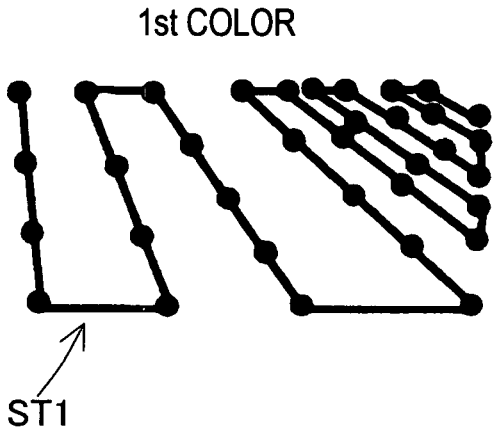
FIG. 34A is an explanatory view which typically illustrates a phase of the process of creating radial stitching data according to the fourth processing method and radial stitching data for a first color.
Figure 34B:
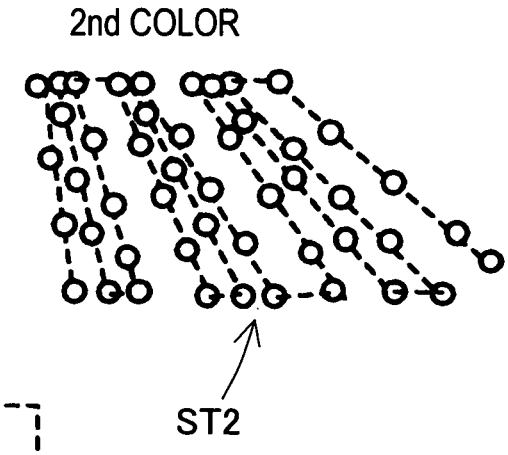
FIG. 34B is an explanatory view which typically illustrates a phase of the process of creating radial stitching data according to the fourth processing method and radial stitching data for a second color.
Figure 34B:
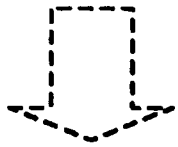
Figure 34C:
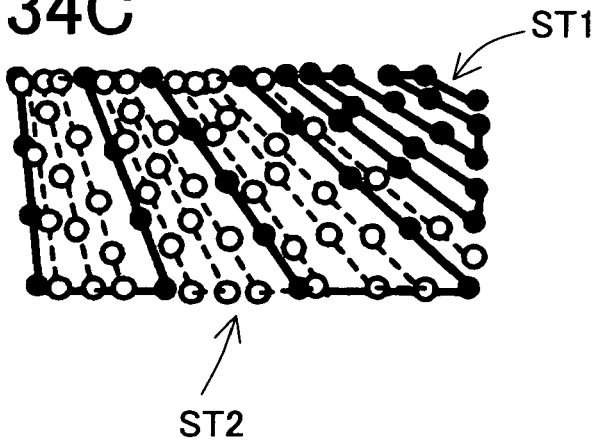
FIG. 34C is an explanatory view which typically illustrates a phase of the process of creating radial stitching data according to the fourth processing method and radial stitching data composed of both stitching data for the first and second colors.

Referring to FIG. 13, when the step S55 has finished, the line L2 into which the lines L1 extracted on the θ-R plane were joined is formed, as shown in FIG. 31B, and then, in S56, the process creates stitch points 32 on the line L2, as shown in FIG. 33A. In S57, the process transforms the line L2 having the stitch points 32 created on the θ-R plane into its correspondent on the-x-y plane by inverse transformation; thereby, radial stitching data is created, as shown in FIG. 33B.

Figure 14:
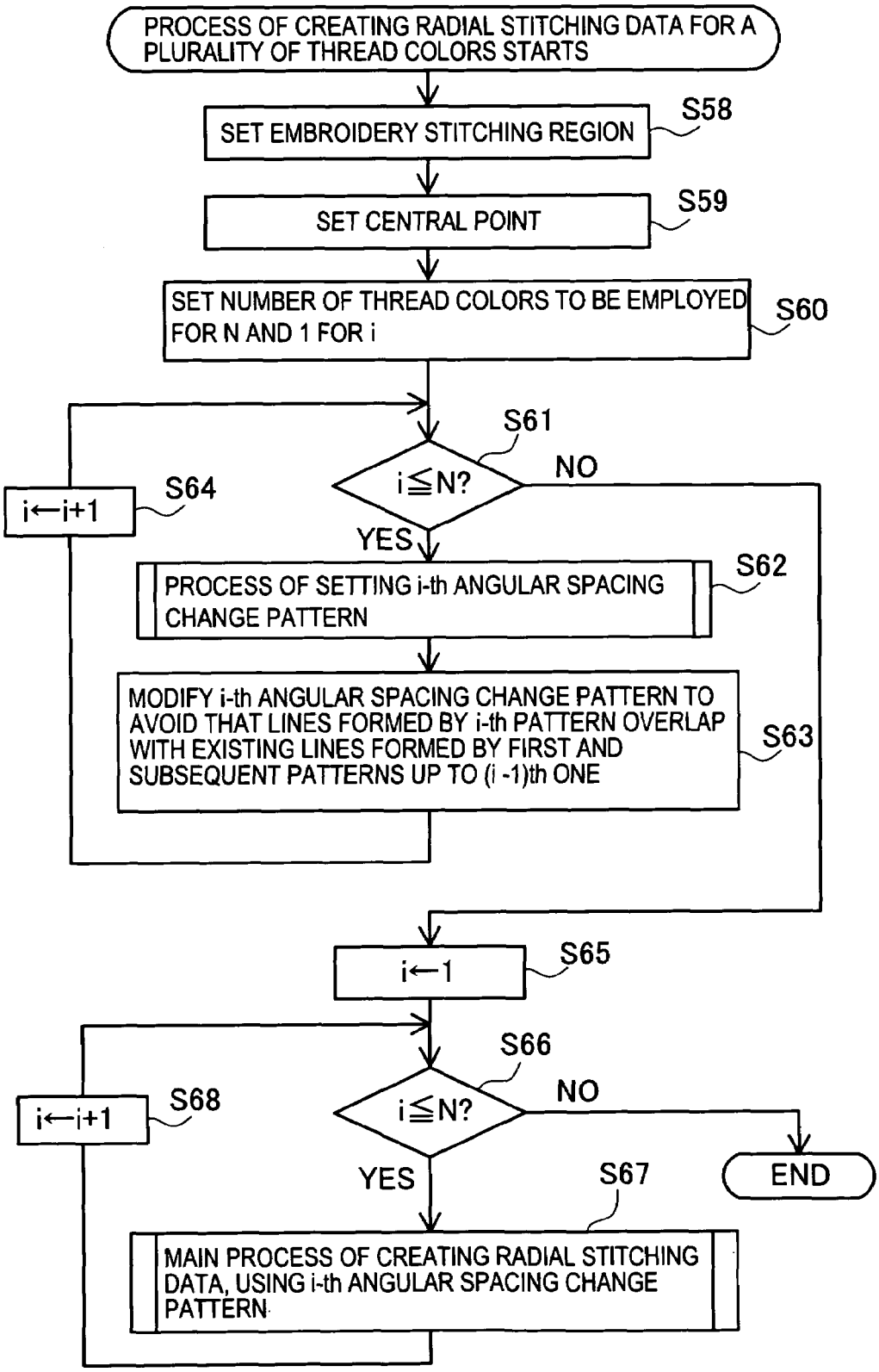
FIG. 14 is a flowchart of a program for a process of creating radial stitching data according to a fourth processing method.

Next, as for the process of creating radial stitching data, its fourth processing method that creates radial stitching data for a plurality of thread colors is described, based on FIG. 14. FIG. 14 is a flowchart of a program for the process of creating radial stitching data according to the fourth processing method.

Referring to FIG. 14, in S58, first, an embroidery region 30 where embroidering stitches should be formed is set, as is the case in the above S35. In S59, a central point C serving as the reference for forming embroidering stitches within the embroidery region 30 is set, as is the case in the above S36.

In the following S60, the number of thread colors that are actually employed is set for the total number of thread colors N and 1 is set for the angular spacing change pattern number i. In particular, if, for instance, five thread colors are employed, 5 is set for the total number of thread colors N.

In S61, the process determines whether the total number of thread colors N is more than or equal to the angular spacing change pattern number i. If the decision at S61 is YES, the process of setting the i-th angular spacing change pattern is performed in S62 (the same process as in the above S37, S39 to S42).

Subsequently, in S63, the process modifies the i-th angular spacing change pattern to avoid that lines formed by the i-th pattern overlap with the existing lines formed by the first and subsequent change patterns up to the (i−1)th one.

Modifying the i-th angular spacing change pattern is basically the same as the above-described modification of the circle-to-circle spacing change pattern shown in FIG. 24 and its explanation is not repeated here.

Subsequently, in S64, the angular spacing change pattern number is incremented by one and the process returns to S61. After the angular spacing change pattern number is incremented by one, if the decision at S61 is YES, the steps S61 and S63 are executed again, the angular spacing change pattern number is incremented by one at S64, and the process returns to S61 again. It is assumed that one angular spacing change pattern exists for each thread color and, therefore, if, for instance, two thread colors are employed, the steps S62 and S63 are repeated twice and the process returns to S61.

As the result of incrementing the angular spacing change pattern number by one as above, if the decision at S61 is NO, the process goes to S65 and the process of creating radial stitching data is performed per each angular spacing change pattern.

Specifically, at S65, 1 is set for the angular spacing change pattern number i and, at S66, the process determines whether the total number of thread colors N is more than or equal to the angular spacing change pattern number i. If the decision at S66 is YES, the process creates radial stitches, using the i-th angular spacing change pattern in S67. This process of creating stitches is the same as the above-described process (see the main process of creating radial stitching data in FIG. 11 or 12 or 13). Subsequently, in S68, the angular spacing change pattern number i is incremented by one and the process returns to step S66. As is the case in the above S61, if, for instance, two thread colors are employed, the step S67 is repeated twice and the process returns to S66. As the result of incrementing the angular spacing change pattern number by one, if the decision at S66 is NO, the radial stitching data creation process terminates.

Now, the process in the above S67 is explained concretely, based on FIG. 34. In FIG. 34, stitching data ST1 for the first color is shown in FIG. 34A and stitching data ST2 for the second color is shown in FIG. 34B. Here, the stitching data ST2 for the second color is created not to overlap with the stitching data ST1 for the first color through the above steps S62 and S63. Thus, when both stitching data ST1 and ST2 are combined, the colors can be mixed in a balanced manner, avoiding that both stitching data ST1 and ST 2 overlap each other, as shown in FIG. 34C.

As detailed hereinbefore, in the embroidery data processing apparatus according to the present embodiment, a plurality of circles 31A to 31J with different radii are formed concentrically around the central point C and concentric stitching data in which stitch points 32 are formed on the plurality of circles and arcs that fall within the embroidery region 30 is created. Thus, the stitching data features thread flows along the arcs and concentric stitches with a new texture, not existing before, can be created.

Calculation is executed for forming a plurality of circles 31A to 31J with different radii concentrically around the central point C, circles and arcs that fall within the embroidery region 30 are extracted from the circles, and stitch points 32 are determined on the circles and arcs that fall within the embroidery region 30. In consequence, the stitching data features thread flows along the arcs and concentric stitches with a new texture, not existing before, can be created.

Moreover, the concentric stitching data creation process involves polar coordinates transformation of the x-y plane into the θ-R plane, by which the central point C is replaced by the point of origin O. Based on this polar coordinates transformation, the process transforms the embroidery region P on the x-y plane into the contour P1 of the embroidery region on the θ-R plane and transforms the plurality of circles with different radii formed concentrically on the central point C on the x-y plane into a plurality of lines parallel to the θ axis on the θ-R plane. The process extracts a group of lines L1 that falls within the contour P1 of the transformed embroidery region from the plurality of parallel lines to the θ axis on the θ-R plane and joins the lines L1 into a line L2 on the θ-R plane. The process executes calculation for creating stitch points 32 on a line L formed by inverse transformation of the line L2 onto the x-y plane or executes calculation for creating stitch points 32 on the line L2 and inverse transformation of the stitch points 32 onto the x-y plane, thus forming the stitch points 32 on the x-y plane. Consequently, the stitching data features thread flows along the arcs and concentric stitches with a new texture, not existing before, can be created.

While forming the plurality of circles 31A to 31J with different radii concentrically around the central point C, the process changes spacing between adjacent circles, as the distance from the central point increases up to the outermost point. It is possible to regularly change spacing between concentric circles for concentric stitches and, thus, variation in circular gradation can be obtained.

Moreover, while forming the plurality of circles 31A to 31J with different radii concentrically around the central point C, the process may monotonously increase or decrease spacing between adjacent circles, as the distance from the central point increases up to the outermost point. It is possible to monotonously change spacing between concentric circles for concentric stitches and, thus, variation in monotonous circular gradation can be obtained.

The process is configured such that, while forming the plurality of circles 31A to 31J with different radii concentrically around the central point C, it changes spacing between adjacent circles, as the distance from the central point increases up to the outermost point, according to a circle-to-circle spacing change pattern specified by the user via the keyboard 5 or the like. According to circle-to-circle spacing change pattern setting specified by the user via the keyboard 5 or the like, variation in circular gradation of concentric stitches can be set.

Moreover, because data for multiple-color concentric stitching around the central point can be created for a plurality of thread colors, variation in circular color gradation can be obtained by concentric stitching with a plurality colors of threads.

Because circle-to-circle spacing change patterns that mutually differ are separately provided for different thread colors, flexible variation in circular color gradation can be obtained by concentric stitching with a plurality colors of threads.

Furthermore, when employing a plurality of thread colors, because circle-to-circle spacing change pattern setting can be adjusted so that the lines of circles for one thread color do not overlap with the lines of circles for another thread color via the keyboard 5 or the like, overlapped stitches are prevented in concentric stitching with a plurality colors of threads, a plurality of colors can be mixed well, and beautiful stitches can be produced.

Because arrangement is made so that circle-to-circle spacing change patterns that are in inverse relation will be used for two colors of threads, average thread density in concentric stitching with two colors can be made substantially constant in any section from the center up to the outermost point.

Moreover, the process forms a plurality of half lines 40 radiating from the central point C at different angles relative to a predetermined reference direction SD, while changing angular spacing between adjacent half lines 40 in a rotation around the central point C, and forms stitch points 32 on the plurality of half lines 40A that fall within the embroidery region 30, thus creating radial stitching data. In consequence, by changing angular spacing of radial stitches from the central point C, variation in conical (radial) gradation can be obtained.

An angular spacing change pattern in which angular spacing between adjacent half lines 40 will change, as the angle relative to the reference direction SD changes, can be specified via the keyboard 5 or the like. According to angular spacing change pattern setting specified via the keyboard 5 or the like, the angular spacing between adjacent half lines can be changed, as the angle relative to the reference direction SD changes. Therefore, variation in conical (radial) gradation in stitching can be set, based on the angular spacing change pattern set by the user via the keyboard 5 or the like.

Moreover, because data for multiple-color radial stitching around the central point can be created for a plurality of thread colors, variation in conical (radial) color gradation can be obtained by radial stitching with a plurality colors of threads.

Because angular spacing change patterns that mutually differ are separately provided for different thread colors, flexible variation in conical (radial) color gradation can be obtained by radial stitching with a plurality colors of threads.

Furthermore, when employing a plurality of thread colors, because angular spacing change pattern setting can be adjusted so that the lines for one thread color do not overlap with the lines for another thread color via the keyboard 5 or the like, overlapped stitches are prevented in radial stitching with a plurality colors of threads, a plurality of colors can be mixed well, and beautiful stitches can be produced.

Because arrangement is made so that angular spacing change patterns that are in inverse relation will be used for two colors of threads, average thread density in radial stitching with two colors can be made substantially constant in any angle position from the central point.

Moreover, the process forms ellipses 33A or the like deformed from a plurality of circles 31A or the like with different radii concentrically around the central point C and forms stitch points 32 on the curves that constitute the ellipses 33A or the like and fall within the embroidery region 30, thus creating stitching data. In consequence, the stitching data features thread flows along elliptical curves and elliptical stitches with a new texture, not existing before, can be created.

It will be appreciated that the present invention is not limited to the embodiment described hereinbefore and numerous modifications and changes can be made without departing from the spirit or essential characteristics thereof.

The present invention can provide an embroidery data processing apparatus that is capable of representing a variety of rich gradation by making effective use of stitching data of concentric and radial patterns of simple formation.

What is claimed is:

1. An embroidery data processing apparatus comprising a processor conducting:

a process of setting an embroidery region where embroidering stitches should be formed;

a process of setting a central point serving as a reference for forming the embroidering stitches within the embroidery region;

a stitching data creation process comprising the steps of:

executing calculation for creating a plurality of circles with different radii concentrically around the central point;

extracting circles and arcs that fall within the embroidery region from the circles; and determining stitch points on the circles and arcs, thus creating concentric stitching data.

2. The embroidery data processing apparatus according to claim 1, wherein the stitching data creation process further comprises the steps of:

executing polar coordinates transformation of an x-y plane into a θ-R plane on which the central point is replaced by a point of origin and transforming the embroidery region on the x-y plane into the embroidery region on the θ-R plane, based on the polar coordinates transformation;

transforming the plurality of circles with different radii formed concentrically around the central point on the x-y plane into a plurality of first lines parallel to the θ axis on the θ-R plane, based on the polar coordinates transformation;

extracting a group of lines that fall within the transformed embroidery region from the plurality of first lines parallel to the θ axis on the θ-R plane; and joining the group of lines into a second line on the θ-R plane, executing calculation for creating stitch points on a third line that is formed by inversely transforming the second line onto x-y coordinates, or executing calculation for creating stitch points on the second line, inversely transforming the stitch points onto the x-y plane, and obtaining the stitch points on the x-y plane.

3. The embroidery data processing apparatus according to claim 1, wherein the stitching data creation process further comprises the step of:

changing spacing between adjacent circles of the plurality of circles with different radii formed concentrically around the central point, as distance from the central point increases up to an outermost point.

4. The embroidery data processing apparatus according to claim 3, wherein the stitching data creation process further comprises the step of:

monotonously increasing or decreasing spacing between adjacent circles of the plurality of circles with different radii formed concentrically around the central point, as distance from the central point increases up to an outermost point.

5. The embroidery data processing apparatus according to claim 3, wherein the processor further conducts a process of setting a circle-to-circle spacing change pattern in which spacing between adjacent circles will change, as distance from the central point increases, and the stitching data creation process further comprises the step of:

changing spacing between adjacent circles of the plurality of circles with different radii formed concentrically around the central point, as distance from the central point increases up to an outermost point, according to a circle-to-circle spacing change pattern set by the circle-to-circle spacing change pattern setting process.

6. The embroidery data processing apparatus according to claim 1, wherein the stitching data creation process further comprises the step of:

creating multiple-color concentric stitching data around the same central point for a plurality of colors of threads.

7. The embroidery data processing apparatus according to claim 6, wherein the stitching data creation process includes circle-to-circle spacing change patterns that mutually differ to be separately used for the colors of threads.

8. The embroidery data processing apparatus according to claim 6, wherein the circle-to-circle spacing change pattern setting process comprises the step of:

for the plurality of thread colors, adjusting a circle-to-circle spacing change pattern to avoid that the lines of circles for one thread color overlap with the lines of circles for another thread color.

9. The embroidery data processing apparatus according to claim 6, wherein the stitching data creation process includes circle-to-circle spacing change patterns that are in inverse relation to be used separately for two colors of threads.

10. An embroidery data processing apparatus comprising a processor conducting:

a process of setting an embroidery region where embroidering stitches should be formed;

a process of setting a central point serving as a reference for forming the embroidering stitches within the embroidery region;

a stitching data creation process comprising the steps of:

changing angular spacing between adjacent half lines of a plurality of half lines radiating from the central point at different angles relative to a predetermined reference direction in a rotation around the central point; and forming stitch points on the plurality of half lines that fall within the embroidery region, thus creating radial stitching data.

11. The embroidery data processing apparatus according to claim 10, wherein the processor further conducts a process of setting an angular spacing change pattern in which angular spacing between adjacent half lines will change, as the angle relative to the reference direction changes, and the stitching data creation process further comprises the step of:

changing angular spacing between adjacent half lines, as the angle relative to the reference direction changes, according to an angular spacing change pattern set by the angular spacing change pattern setting process.

12. The embroidery data processing apparatus according to claim 10, wherein the stitching data creation process further comprises the step of:

creating multiple-color radial stitching data around the same central point for a plurality of colors of threads.

13. The embroidery data processing apparatus according to claim 12, wherein the stitching data creation process includes angular spacing change patterns that mutually differ to be separately used for the colors of threads.

14. The embroidery data processing apparatus according to claim 12, wherein the angular spacing change pattern setting process comprises the step of:

for a plurality of thread colors, adjusting an angular spacing change pattern to avoid that the lines for one thread color overlap with the lines for another thread color.

15. The embroidery data processing apparatus according to claim 12, wherein the stitching data creation process includes angular spacing change patterns that are in inverse relation to be used separately for two colors of threads.

16. An embroidery data processing apparatus comprising a processor conducting:

a process of setting an embroidery region where embroidering stitches should be formed;

a process of setting a central point serving as a reference for forming the embroidering stitches within the embroidery region;

a stitching data creation process comprising the steps of:

executing calculation for creating ellipses deformed from a plurality of circles with different radii concentrically around the central point;

extracting curves that fall within the embroidery region from the ellipses; and forming stitch points on the curves, thus creating stitching data.

17. A computer-readable recording medium storing an embroidery data processing program, comprising:

a program for setting an embroidery region where embroidering stitches should be formed;

a program for setting a central point serving as a reference for forming the embroidering stitches within the embroidery region; and a stitching data creation program comprising the steps of:

executing calculation for creating a plurality of circles with different radii concentrically around the central point;

extracting circles and arcs that fall within the embroidery region from the circles; and determining stitch points on the circles and arcs, thus creating concentric stitching data.

18. The computer-readable recording medium according to claim 17, wherein the stitching data creation program further comprises the steps of:

executing polar coordinates transformation of an x-y plane into a θ-R plane on which the central point is replaced by a point of origin and transforming the embroidery region on the x-y plane into the embroidery region on the θ-R plane, based on the polar coordinates transformation;

transforming the plurality of circles with different radii formed concentrically around the central point into a plurality of first lines parallel to the θ axis on the θ-R plane, based on the polar coordinates transformation;

extracting a group of lines that fall within the embroidery region from the plurality of first lines parallel to the θ axis on the θ-R plane; and joining the group of lines into a second line on the θ-R plane, executing calculation for creating stitch points on a third line that is formed by inversely transforming the second line onto x-y coordinates, or executing calculation for creating stitch points on the second line, inversely transforming the stitch points onto the x-y plane, and obtaining the stitch points on the x-y plane.

19. The computer-readable recording medium according to claim 17, wherein the stitching data creation program further comprises the step of:

changing spacing between adjacent circles of the plurality of circles with different radii formed concentrically around the central point, as distance from the central point increases up to an outermost point.

20. The computer-readable recording medium according to claim 19, wherein the stitching data creation program further comprises the step of:

monotonously increasing or decreasing spacing between adjacent circles of the plurality of circles with different radii formed concentrically around the central point, as distance from the central point increases up to an outermost point.

21. The computer-readable recording medium according to claim 19, wherein the embroidery data processing program further comprises a program for setting a circle-to-circle spacing change pattern in which spacing between adjacent circles will change, as distance from the central point increases, and the stitching data creation program further comprises the step of:

changing spacing between adjacent circles of the plurality of circles with different radii formed concentrically around the central point, as distance from the central point increases up to an outermost point, according to a circle-to-circle spacing change pattern set by the circle-to-circle spacing change pattern setting program.

22. The computer-readable recording medium according to claim 17, wherein the stitching data creation program further comprises the step of:

creating multiple-color concentric stitching data around the same central point for a plurality of colors of threads.

23. The computer-readable recording medium according to claim 22, wherein the stitching data creation program includes circle-to-circle spacing change patterns that mutually differ to be separately used for the colors of threads.

24. The computer-readable recording medium according to claim 22, wherein the circle-to-circle spacing change pattern setting program comprises the step of:

for a plurality of thread colors, adjusting a circle-to-circle spacing change pattern to avoid that the lines of circles for one thread color overlap with the lines of circles for another thread color.

25. The computer-readable recording medium according to claim 22, wherein the stitching data creation program includes circle-to-circle spacing change patterns that are in inverse relation to be used separately for two colors of threads.

26. A computer-readable recording medium storing an embroidery data processing program comprising:

a program for setting an embroidery region where embroidering stitches should be formed;

a program for setting a central point serving as a reference for forming the embroidering stitches within the embroidery region; and a stitching data creation program comprising the steps of:

changing angular spacing between adjacent half lines of a plurality of half lines radiating from the central point at different angles relative to a predetermined reference direction in a rotation around the central point; and forming stitch points on the plurality of half lines that fall within the embroidery region, thus creating radial stitching data.

27. The computer-readable recording medium according to claim 26, wherein the embroidery data processing program further comprises a program for setting an angular spacing change pattern in which angular spacing between adjacent half lines will change, as the angle relative to the reference direction changes, and the stitching data creation program further comprises the step of:

changing angular spacing between adjacent half lines, as the angle relative to the reference direction changes, according to an angular spacing change pattern set by the angular spacing change pattern setting program.

28. The computer-readable recording medium according to claim 26, wherein the stitching data creation program further comprises the step of:

creating multiple-color radial stitching data around the same central point for a plurality of colors of threads.

29. The computer-readable recording medium according to claim 28, wherein the stitching data creation program includes angular spacing change patterns that mutually differ to be separately used for the colors of threads.

30. The computer-readable recording medium according to claim 28, wherein the angular spacing change pattern setting program comprises the step of:

for a plurality of thread colors, adjusting an angular spacing change pattern to avoid that the lines for one thread color overlap with the lines for another thread color.

31. The computer-readable recording medium according to claim 28, wherein the stitching data creation program includes angular spacing change patterns that are in inverse relation to be used separately for two colors of threads.

32. A computer-readable recording medium storing an embroidery data processing program comprising:

a program for setting an embroidery region where embroidering stitches should be formed;

a program for setting a central point serving as a reference for forming the embroidering stitches within the embroidery region; and a stitching data creation program comprising the steps of:

executing calculation for creating ellipses deformed from a plurality of circles with different radii concentrically around the central point;

extracting curves that fall within the embroidery region from the ellipses; and forming stitch points on the curves, thus creating stitching data.

* * * * *